US009097100B2

(12) United States Patent
Finke et al.

(10) Patent No.: US 9,097,100 B2
(45) Date of Patent: Aug. 4, 2015

(54) DOWNHOLE SENSOR TOOL WITH A SEALED SENSOR OUTSERT

(75) Inventors: Michael Dewayne Finke, Cypress, TX (US); Ricardo Ortiz, Houston, TX (US); Kristopher V. Sherrill, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 530 days.

(21) Appl. No.: 13/321,546

(22) PCT Filed: May 20, 2010

(86) PCT No.: PCT/US2010/035663
§ 371 (c)(1),
(2), (4) Date: Nov. 19, 2011

(87) PCT Pub. No.: WO2010/135584
PCT Pub. Date: Nov. 25, 2010

(65) Prior Publication Data

US 2012/0096935 A1 Apr. 26, 2012

Related U.S. Application Data

(60) Provisional application No. 61/180,071, filed on May 20, 2009.

(51) Int. Cl.
*E21B 47/01* (2012.01)

(52) U.S. Cl.
CPC ..... *E21B 47/011* (2013.01); *E21B 47/01* (2013.01)

(58) Field of Classification Search
CPC ..... E21B 47/01
USPC ..... 73/54.41
See application file for complete search history.

(56) References Cited

U.S. PATENT DOCUMENTS

| | | | | |
|---|---|---|---|---|
| 3,011,554 | A | 12/1961 | Desbrandes et al. | |
| 3,611,799 | A | 10/1971 | Davis | |
| 3,859,851 | A | 1/1975 | Urbanosky | |
| 4,048,495 | A | 9/1977 | Ellis | |
| 4,343,187 | A * | 8/1982 | Kaji | 73/654 |
| 4,416,152 | A | 11/1983 | Wilson | |
| 4,492,865 | A | 1/1985 | Murphy et al. | |
| 4,507,957 | A | 4/1985 | Montgomery et al. | |

(Continued)

FOREIGN PATENT DOCUMENTS

WO 2001063093 A1 8/2001

OTHER PUBLICATIONS

International Application No. PCT/US2010/035663 Search Report and Written Opinion dated Dec. 23, 2010.

(Continued)

*Primary Examiner* — John Fitzgerald

(57) ABSTRACT

A downhole sensor tool includes a sensor outsert coupled into an exterior pocket of the tool body. The sensor outsert is a pressure vessel with an exterior electrical connector coupled to the interior sensor. The sensor outsert contains a sensor, and is pressure-sealed about the sensor. The outsert includes an electrical connector coupled to the sensor. The electrical connector maintains the pressure seal of the outsert. The electrical connector may be a hermetic connector. The electrical connector can be coupled to an electrical connector or a hermetic connector of the tool body while maintaining the sealing of the pressure vessel.

30 Claims, 19 Drawing Sheets

(56) References Cited

U.S. PATENT DOCUMENTS

| | | | | |
|---|---|---|---|---|
| 4,570,481 | A * | 2/1986 | McLaurin | 73/152.03 |
| 4,583,595 | A | 4/1986 | Czernichow et al. | |
| 4,631,711 | A * | 12/1986 | Fowler | 367/149 |
| 4,661,700 | A | 4/1987 | Holenka | |
| 4,711,123 | A * | 12/1987 | Christensen | 73/152.54 |
| 4,721,355 | A | 1/1988 | Gould | |
| 4,750,570 | A | 6/1988 | Barrett | |
| 4,958,073 | A | 9/1990 | Becker et al. | |
| 5,033,297 | A * | 7/1991 | Gustafson | 73/152.55 |
| 5,036,916 | A | 8/1991 | Bennett | |
| 5,134,285 | A | 7/1992 | Perry et al. | |
| 5,203,723 | A * | 4/1993 | Ritter | 439/589 |
| 5,216,242 | A | 6/1993 | Perry et al. | |
| 5,337,234 | A | 8/1994 | Anderson et al. | |
| 5,361,839 | A | 11/1994 | Griffith et al. | |
| 5,486,695 | A * | 1/1996 | Schultz et al. | 250/261 |
| 5,540,280 | A | 7/1996 | Schultz et al. | |
| 5,704,425 | A | 1/1998 | Divis et al. | |
| 5,743,343 | A | 4/1998 | Heller et al. | |
| 5,803,186 | A | 9/1998 | Berger et al. | |
| 5,804,820 | A | 9/1998 | Evans et al. | |
| 5,826,662 | A | 10/1998 | Beck et al. | |
| 6,209,632 | B1 * | 4/2001 | Holbert et al. | 166/65.1 |
| 6,466,513 | B1 * | 10/2002 | Pabon et al. | 367/35 |
| 6,467,544 | B1 | 10/2002 | Brown et al. | |
| 6,655,452 | B2 * | 12/2003 | Zillinger | 166/66 |
| 6,659,177 | B2 | 12/2003 | Bolze et al. | |
| 6,666,285 | B2 | 12/2003 | Jones et al. | |
| 6,688,390 | B2 | 2/2004 | Bolze et al. | |
| 6,814,162 | B2 | 11/2004 | Moran et al. | |
| 6,837,314 | B2 | 1/2005 | Krueger et al. | |
| 6,915,686 | B2 | 7/2005 | Baustad | |
| 6,942,043 | B2 | 9/2005 | Kurkoski | |
| 6,995,684 | B2 | 2/2006 | Clark | |
| 7,178,607 | B2 | 2/2007 | Mayes | |
| 7,367,392 | B2 * | 5/2008 | Duong et al. | 166/249 |
| 7,367,394 | B2 | 5/2008 | Villareal et al. | |
| 7,394,257 | B2 * | 7/2008 | Martinez et al. | 324/356 |
| 7,980,331 | B2 * | 7/2011 | Hall et al. | 175/320 |
| 8,307,703 | B2 * | 11/2012 | Moake | 73/152.03 |
| 2002/0060067 | A1 | 5/2002 | Bolze et al. | |
| 2003/0007058 | A1 | 1/2003 | Odamura et al. | |
| 2003/0033866 | A1 | 2/2003 | Diakonov et al. | |
| 2003/0066646 | A1 | 4/2003 | Shammai et al. | |
| 2003/0098156 | A1 | 5/2003 | Follini et al. | |
| 2003/0155121 | A1 * | 8/2003 | Jones et al. | 166/254.2 |
| 2003/0221824 | A1 | 12/2003 | Solfronk et al. | |
| 2004/0011525 | A1 | 1/2004 | Jones et al. | |
| 2004/0251048 | A1 | 12/2004 | Kurkoski | |
| 2006/0054803 | A1 | 3/2006 | Labous et al. | |
| 2006/0266518 | A1 * | 11/2006 | Woloson | 166/250.01 |
| 2008/0061225 | A1 * | 3/2008 | Orban et al. | 250/269.3 |
| 2009/0038848 | A1 * | 2/2009 | Garcia-Osuna | 175/40 |
| 2009/0108382 | A1 * | 4/2009 | Eriksen et al. | 257/419 |
| 2009/0260876 | A1 * | 10/2009 | Gleitman | 175/24 |
| 2010/0071794 | A1 * | 3/2010 | Homan | 138/125 |
| 2010/0132434 | A1 * | 6/2010 | Moake | 73/1.82 |
| 2011/0253447 | A1 * | 10/2011 | Gleitman | 175/48 |
| 2013/0061668 | A1 * | 3/2013 | Moake | 73/152.16 |

OTHER PUBLICATIONS

International Application No. PCT/US2010/035672 Search Report and Written Opinion dated Feb. 1, 2011.

Singapore Patent Application No. 201108421-7 Written Opinion dated Dec. 11, 2012.

"Design, Development and Field Introduction of a Unique Low-Frequency (20KHZ) Induction Resistivity Logging-While-Drilling Tool", SPWLA 45th Annual Logging Symposium, Jun. 6-9, 2004, Victor Allan, Paul Sinclair, et al.

* cited by examiner

DOWNHOLE SENSOR TOOL WITH A SEALED SENSOR OUTSERT

CROSS-REFERENCE TO RELATED APPLICATIONS

This application is the U.S. National Stage Under 35 U.S.C. §371 of International Patent Application No. PCT/US2010/035663 filed May 20, 2010, entitled "Downhole Sensor Tool With A Sealed Sensor Outsert", which claims priority to U.S. provisional application Ser. No. 61/180,071 filed May 20, 2009, entitled "Downhole Sensor Tool With A Sealed Outsert".

BACKGROUND

Successful drilling, completion and production of an earthen wellbore requires that information be gathered about the downhole formation from which hydrocarbons are produced. Measurement systems are lowered into a drilled wellbore to determine wellbore parameters and operating conditions. A portion of the measurement system includes a sensor package for detecting the wellbore parameters and conditions, such as formation properties, tool and borehole direction, drilling fluid properties, dynamic drilling conditions, and others. The sensor package may be lowered on a tool body after the drill string is tripped out of the borehole, such as with a typical wireline operation. Alternatively, the sensors may be housed in a drill collar and adapted for taking measurements while drilling, as in certain applications known as measurement-while-drilling (MWD) or logging-while-drilling (LWD). In addition to the sensor portion, a sensor tool may also include a processor and associated storage medium for retaining the sensed information. With respect to a MWD/LWD tool, a telemetry system is often used to transmit the sensed information uphole. The telemetry system may include a mud pulser, an acoustic telemetry option, or an electromagnetic transmission system.

The sensors and associated electronic and mechanical components are packaged within the tool body. For example, the sensors and detectors may be hardwired within the tool body and accessible via removable hatches. In another arrangement, the sensors are mounted upon a chassis and retained within an outer housing. However, such sensor packages are restricted by limited accessibility, wherein the sensor package components are accessed by disassembly of tool body parts or additional features such as access ports. They are not easily removed and/or replaced.

Specifically with respect to MWD/LWD tools, there are high capital and operating costs, and the tools must be adaptable to varying drill string sizes. Furthermore, the drilling environment is very dynamic with fluctuating pressures and temperatures, making precision measurements by the sensors difficult. Thus, the sensor package must provide robust isolation from the drilling environment, including a good pressure seal between the sensors and the environment exterior of the drill collar.

Sensors have been placed in insert-type packages wherein a housing receives a sensor case and a cover or sleeve is disposed over the housing to retain the sensor cases. These sensor cases are termed "inserts" because they are internal to the tool (within the cover or sleeve) and, if sealed, are dependent on the cover or sleeve or other external pressure case for sealing from the environment exterior of the tool. An insert is not accessible from an exterior of the tool. Some tools provide a pocket on the outside of the tool body and a sensor case that is placed in the pocket. Such a sensor case is accessible from an exterior of the tool, thus it is termed an "outsert." The outsert may be sealed by an external pressure case, such as a hatch that fits into the pocket opening and seals the pocket. However, such external pressure cases are unreliable.

The high capital and operating costs of measurement tools, particularly the MWD/LWD type, require that sensor packages provide easy removability and replaceability of the sensors, flexibility to be used in measurement tools of various sizes, and robust sealing from the downhole environment. Despite the aforementioned advances, the current sensor packages are limited in such a way that this combination of parameters cannot be met.

BRIEF DESCRIPTION OF THE DRAWINGS

For a detailed description of exemplary embodiments, reference will now be made to the accompanying drawings in which.

DETAILED DESCRIPTION

Figure 1:
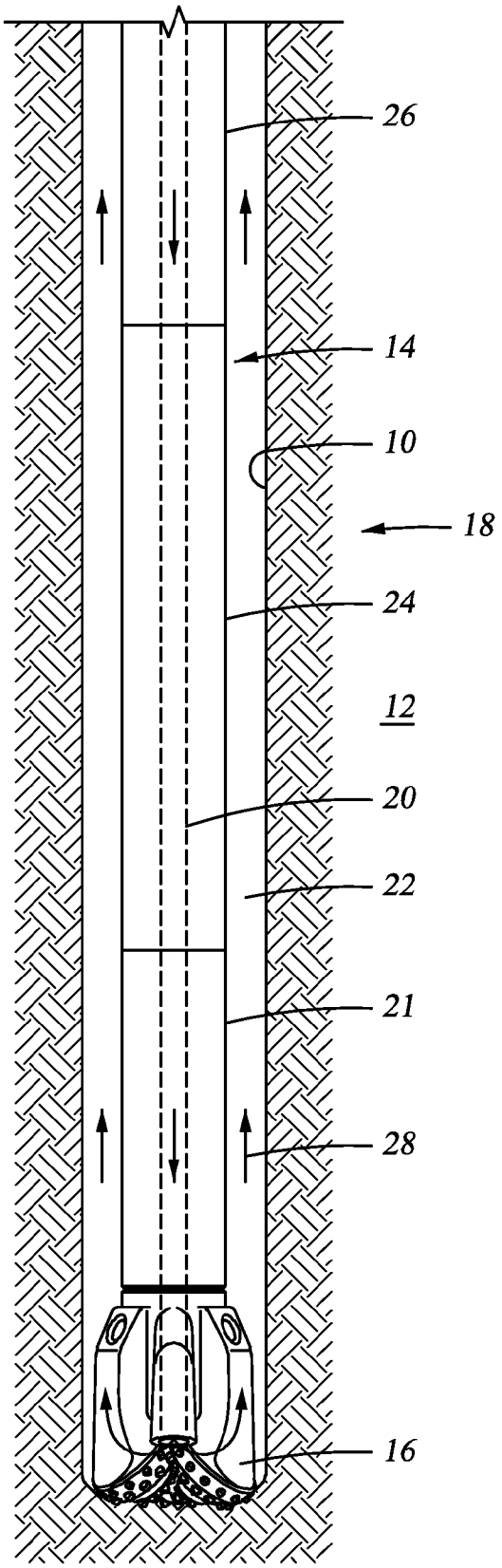
FIG. 1 shows a schematic side view of an exemplary drill string and bottom hole assembly including a MWD/LWD drill collar assembly according to an embodiment in accordance with principles disclosed herein.

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

In the following discussion and in the claims, the terms "including" and "comprising" are used in an open-ended fashion, and thus should be interpreted to mean "including, but not limited to . . . ". Unless otherwise specified, any use of any form of the terms "connect", "engage", "couple", "attach", or any other term describing an interaction between elements is not meant to limit the interaction to direct interaction between the elements and may also include indirect interaction between the elements described. Reference to up or down will be made for purposes of description with "up", "upper", "upwardly" or "upstream" meaning toward the surface of the well and with "down", "lower", "downwardly" or "downstream" meaning toward the terminal end of the well, regardless of the well bore orientation. In addition, in the discussion and claims that follow, it may be sometimes stated that certain components or elements are in fluid communication. By this it is meant that the components are constructed and interrelated such that a fluid could be communicated between them, as via a passageway, tube, or conduit. Also, the designation "MWD" or "LWD" are used to mean all generic measurement while drilling or logging while drilling apparatus and systems. The various characteristics mentioned above, as well as other features and characteristics described in more detail below, will be readily apparent to those skilled in the art upon reading the following detailed description of the embodiments, and by referring to the accompanying drawings.

Referring initially to FIG. 1, a schematic side view of a drill string 14 is shown disposed in a borehole 10. Attached at the lower end of the drill string 14 is a bottom hole assembly (BHA) 18 including a drill bit 16 for drilling the borehole 10 in an earth formation 12. The flowbore 20 provides drilling fluid from the surface downward to and out through the drill bit 16. The drilling fluid then returns to the surface of the wellbore via an annulus 22, as shown by arrows 28.

The BHA assembly 18 includes numerous components, such as the drill bit, a directional drilling device, stabilizers, LWD/MWD sensors and drill collars. In FIG. 1, the drill bit 16 may be coupled to a directional drilling device 21, which is coupled to an LWD/MWD tool 24. The tool 24 may be coupled to a drill collar 26, which connects to the drill pipe. The directional device 21, which can be a mud motor or rotary steerable system, is optional depending on the bore hole objective. The LWD/MWD sensors can be an integral part of the directional device 21, or a separate sensor sub 24 located immediately above the directional device. Additional MWD/LWD system components include, for example, a processor and storage medium, a power supply such as batteries or a turbine for generating electrical power, a telemetry device, hydraulic operating circuits, sensors, and other components. The present disclosure is not limited to the additional MWD/LWD components listed specifically herein as it is known for these systems to include other components, such other components being contemplated by the present disclosure. Drill collars, such as the collar 26, are used to apply weight on the drill bit 16. These drill collars can be located anywhere in the BHA 18, but are typically located at the top end of the BHA to allow the LWD/MWD sensor sub 24 to be as close as possible to the bit 16. Stabilizers are located as required anywhere in the BHA.

Figure 2:
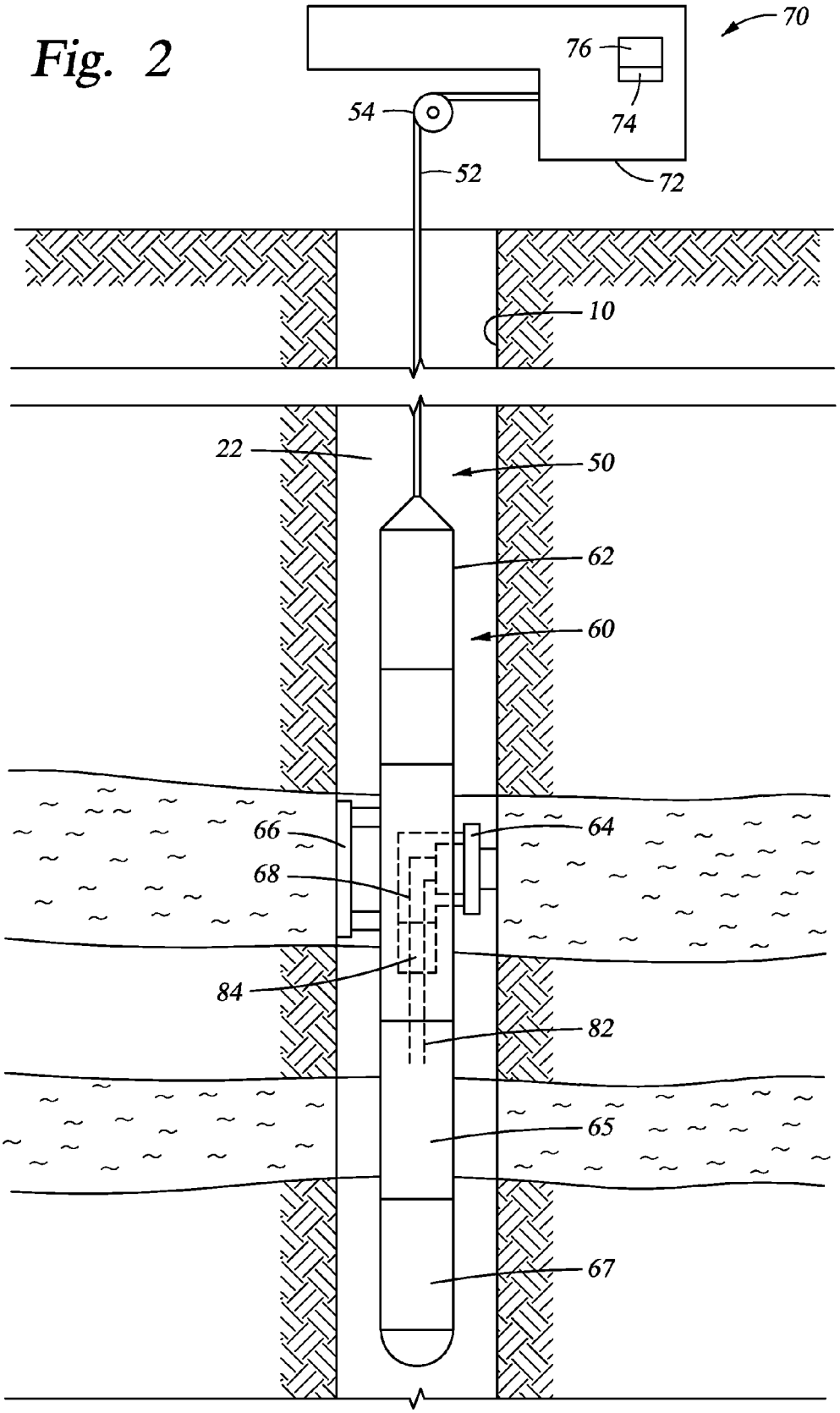
FIG. 2 is a schematic view, partly in cross-section, of a sensor tool conveyed by wireline.

In some embodiments, the sensor packaging embodiments described herein are included in the LWD/MWD portion 24. In some embodiments, the sensor packaging embodiments are located in any section of the BHA 18, including the directional device 21. It should be noted, however, that the drill collar and MWD/LWD assembly is only one conveyance that may be used to lower the sensor package embodiments into the borehole 10, and is used for clarity of description. Alternatively, the sensor package may be coupled to a longitudinal body conveyed downhole using other means. For example, and with reference to FIG. 2, a sensor tool 60 is disposed on a tool string 50 conveyed into the borehole 8 by a cable 52 and a winch 54. The sensor tool includes a body 62, a sampling assembly 64, a backup assembly 66, analysis modules 68, 84 including electronic devices, a flowline 82, a battery module 65, and an electronics module 67. The sensor tool 60 is coupled to a surface unit 70 that may include an electrical control system 72 having an electronic storage medium 74 and a control processor 76. In other embodiments, the tool 60 may alternatively or additionally include an electrical control system, an electronic storage medium and a processor.

Figure 3:
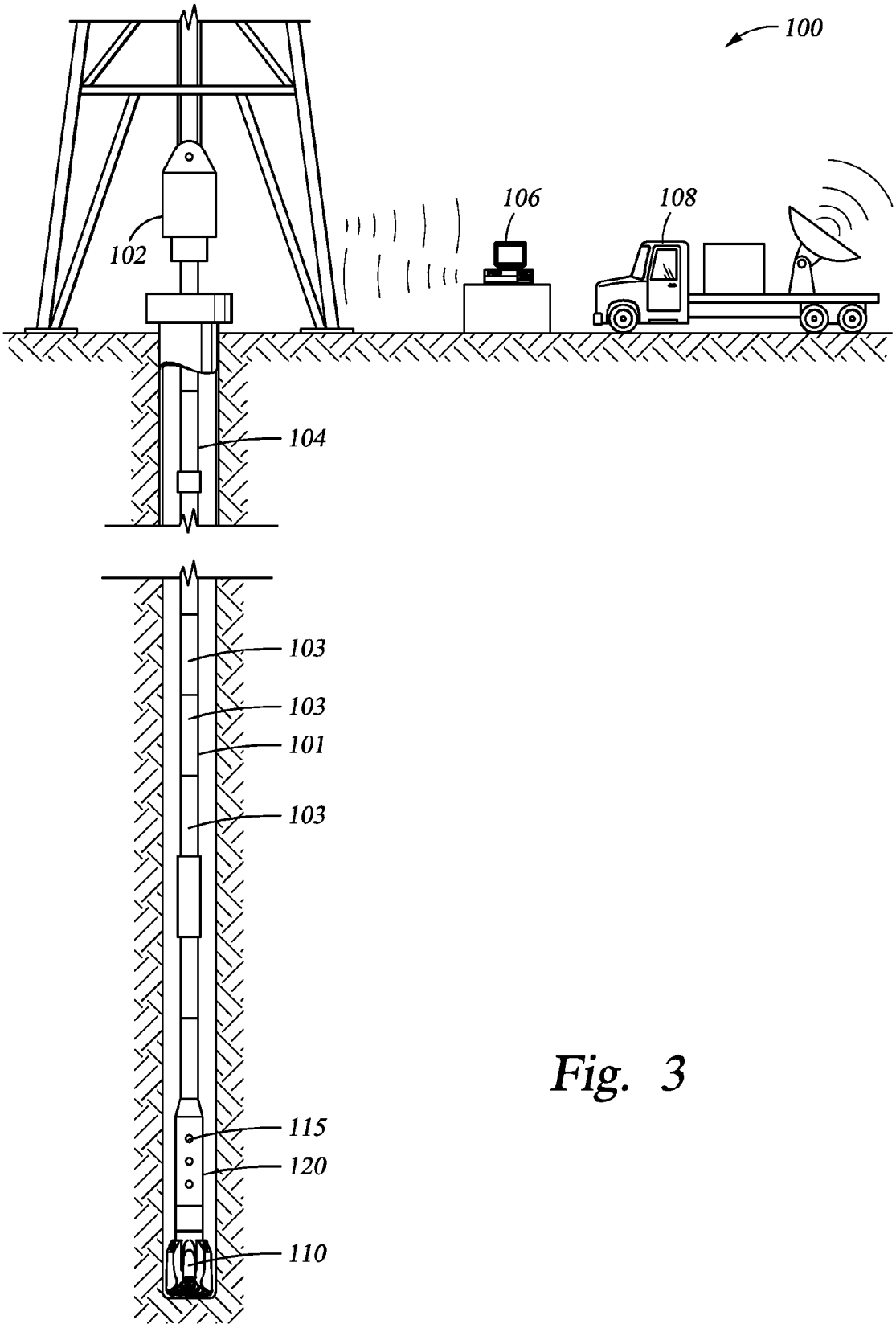
FIG. 3 is a schematic view, partly in cross-section, of a sensor tool disposed on a wired drill pipe connected to a telemetry network.
Figure 4:
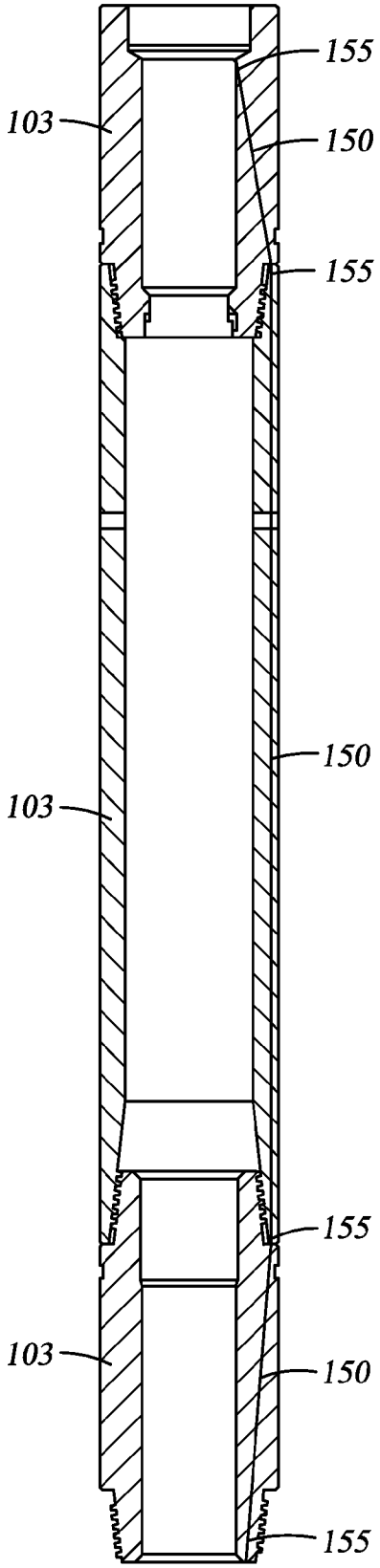
FIG. 4 is a cross-section view of a section of wired drill pipe.

In other embodiments, the conveyance includes wired tubing or pipe. Referring to FIG. 3, a telemetry network 100 is shown. A sensor tool 120 is coupled to a drill string 101 formed by a series of wired drill pipes 103 connected for communication across junctions using communication elements. Referring to FIG. 4, sections of wired drill pipe 103 are shown including conductors 150 that traverse the entire length of the pipe sections. Communication elements 155 allow the transfer of power and/or data between the pipe sections 103. A data/power signal may be transmitted along a pipe section of the wired drill string, such as the tool 120, from one end through the conductor(s) 150 to the other end across the communication elements 155.

It will be appreciated that work string 101 can be other forms of conveyance, such as coiled tubing or wired coiled tubing. The downhole drilling and control operations are interfaced with the rest of the world in the network 100 via a top-hole repeater unit 102, a kelly 104 or top-hole drive (or, a transition sub with two communication elements), a computer 106 in the rig control center, and an uplink 108. The computer 106 can act as a server, controlling access to network 100 transmissions, sending control and command signals downhole, and receiving and processing information sent up-hole. The software running the server can control access to the network 100 and can communicate this information via dedicated land lines, satellite uplink 108), Internet, or other means to a central server accessible from anywhere in the world. The sensor tool 120 is shown linked into the network 100 just above the drill bit 110 for communication along its conductor path and along the wired drill string 101.

Portions of wired drill pipes 103 may be subs or other connections means. In some embodiments, the conductor(s) 150 comprise coaxial cables, copper wires, optical fiber cables, triaxial cables, and twisted pairs of wire. The ends of the wired subs 103 are configured to communicate within a downhole network as described herein. The communication elements 155 may comprise inductive couplers, direct electrical contacts, optical couplers, and combinations thereof. The conductor 150 may be disposed through a hole formed in the walls of the outer tubular members of the pipes 103.

The tool 120 may include a plurality of transducers 115 disposed on the tool 120 to relay downhole information to the operator at surface or to a remote site. The transducers 115 may include any conventional source/sensor (e.g., pressure, temperature, gravity, etc.) to provide the operator with formation and/or borehole parameters, as well as diagnostics or position indication relating to the tool. The telemetry network 100 may combine multiple signal conveyance formats (e.g., mud pulse, fiber-optics, acoustic, EM hops, etc.). It will also be appreciated that software/firmware may be configured into the tool 120 and/or the network 100 (e.g., at surface, downhole, in combination, and/or remotely via wireless links tied to the network).

Figure 5:
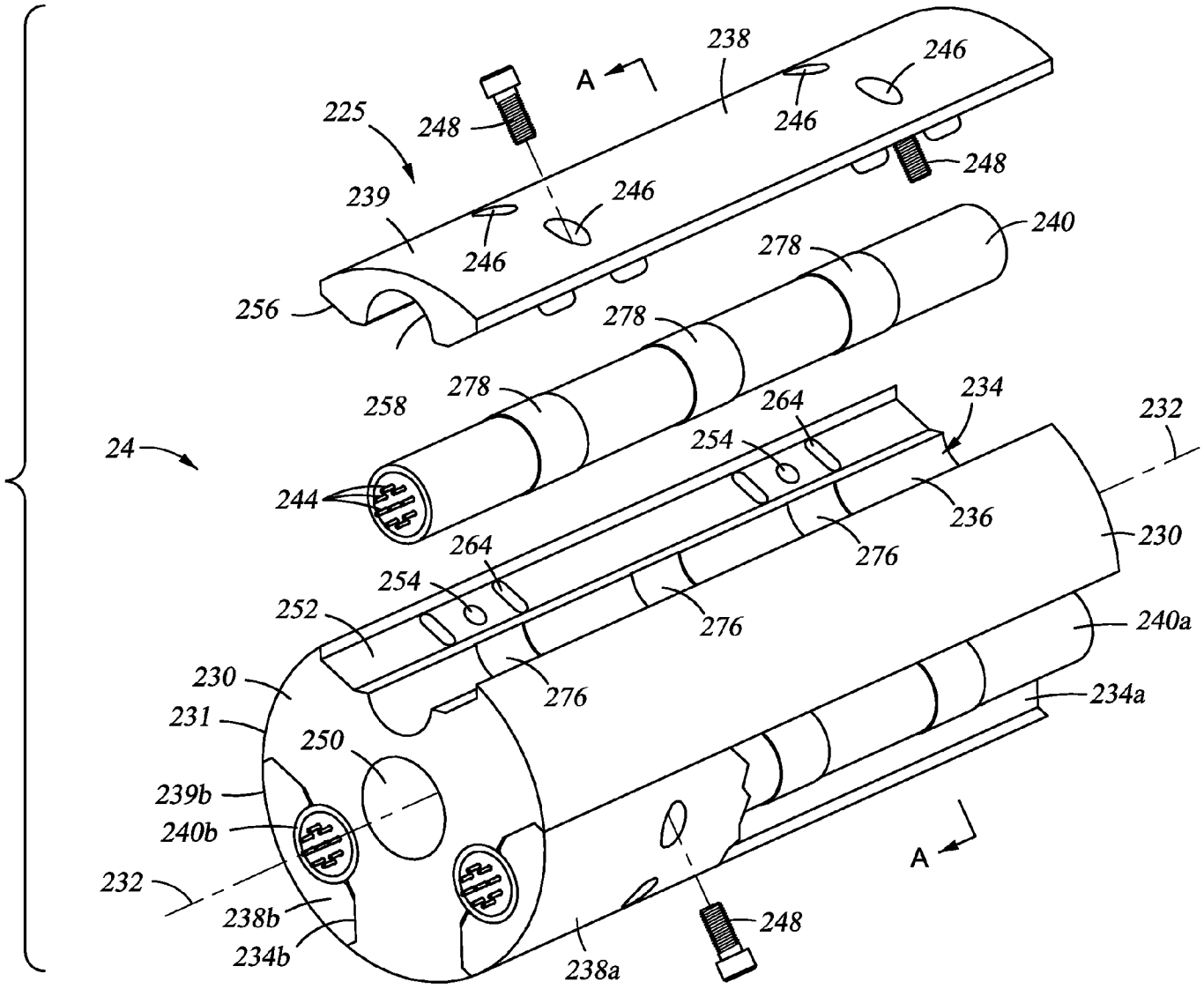
FIG. 5 shows a perspective, partially exploded view of a drill collar assembly according to an embodiment in accordance with principles disclosed herein.
Figure 6:
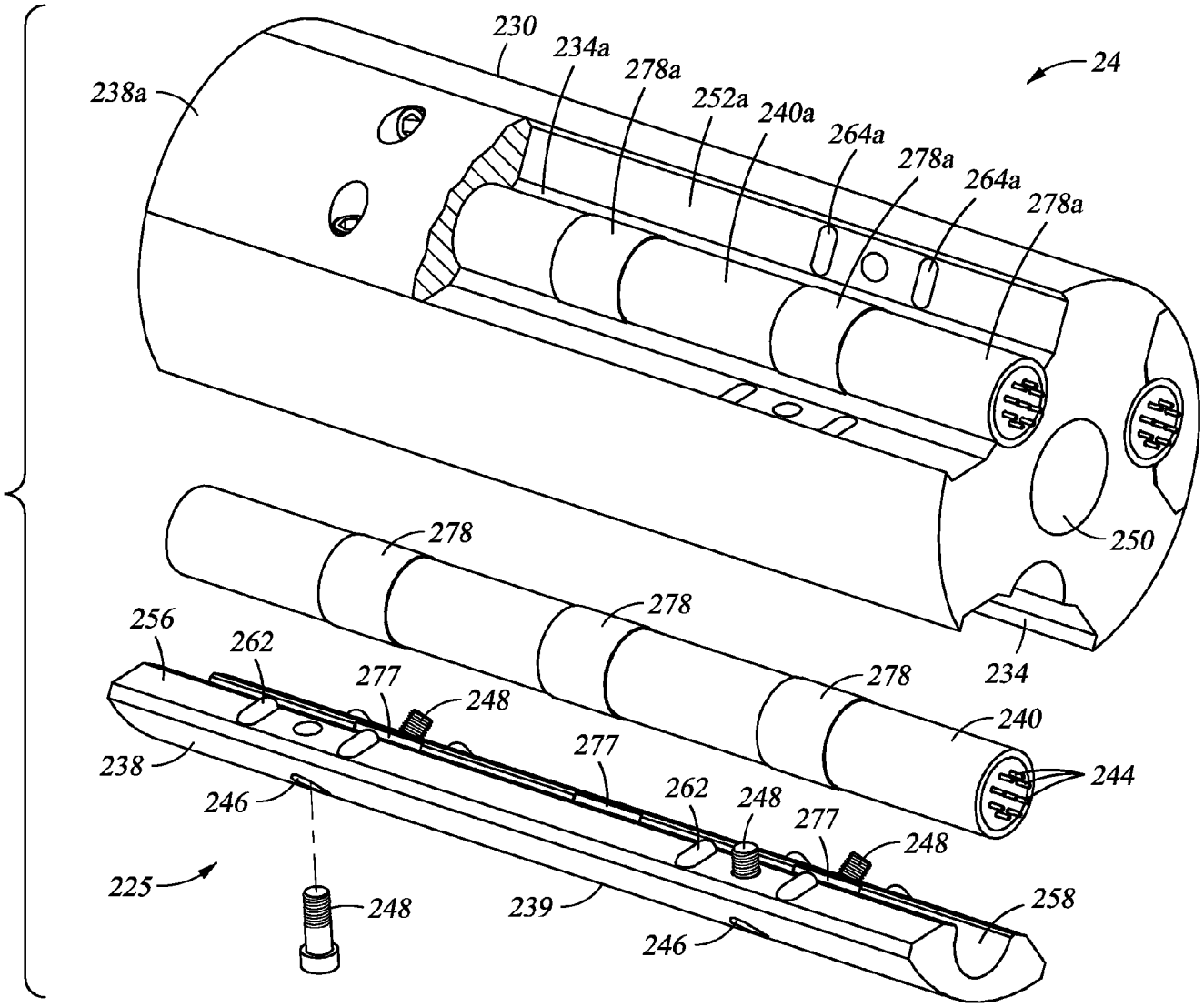
FIG. 6 shows another perspective, partially exploded view of the drill collar assembly of FIG. 2.

As previously explained, the sensor sub 24 includes the embodiments of the sensor package now described for ease of description. Referring now to FIGS. 5 and 6, the drill collar assembly 24 is shown in two perspective, partially exploded views. In FIG. 5, the drill collar assembly 24 includes a drill collar 230 having a flow bore 250 and at least one recess or pocket 234 formed therein. The pocket 234 generally extends parallel to a longitudinal axis 232 of the drill collar 230. The pockets may be machined into the outer diameter of the drill collar 230, or formed in other ways known in the art, such that the pocket is accessible from an exterior of the drill collar 230. In the embodiment shown in FIG. 5, additional pockets 234*a*, 234*b* are also formed in portions of the drill collar 230. The pockets 234, 234*a*, 234*b* are shown disposed about the drill collar in parallel approximately 120 degrees apart. Alternatively, the pockets may be disposed in series (stacked end to end) along the drill collar axis 232. In any embodiment including multiple pockets, the pockets may be located in any position. The pockets may be positioned according to other requirements. For example, the distance between pockets may be sized as necessary to increase the torsional stiffness of the collar 230. The pockets may vary in size to accommodate outserts of varying sizes.

The pocket 234 includes an inner portion or groove 236 for receiving a sensor outsert assembly 225. The sensor outsert assembly 225 generally includes a sensor outsert 240, a cover 238, and one or more locking bolts 248. The sensor outsert 240 contains the sensors, and is generally an elongated tubular member having electrical connections 244 at its ends. The outsert 40 will be described in more detail with reference to the figures that follow.

Referring still to FIG. 5, the sensor outsert 240 is placed in the outsert groove 236. The cover 238 is placed over the outsert 240. The cover 238 includes a bottom surface 256 for engaging the cover mounting surface 252 of the pocket 234. The bottom surface 256 includes a recess or outsert groove 258 for engaging and retaining the outsert 240 in the pocket 234. An outer surface 239 of the cover 238 is generally cylindrically shaped such that it matches the cylindrical outer shape of the drill collar 230. As shown with cover 238*b*, outer surface 239*b* is substantially flush with outer surface 231 of the drill collar 230 when cover 238*b* is locked in position such as to form a continuous outer surface of the drill collar assembly 24. In some embodiments, the outer surface of the covers are different shapes, non-coincident with the outer surface of the collar, or a combination thereof. In some embodiments, the outer surface of the collar is cylindrically shaped, as shown, while other embodiments include outer surfaces of other shapes or geometries.

To lock the covers into position, as shown with respect to the covers 238*a* and 238*b*, bolts 248 are placed through bolt holes 246 in the cover 238 and threaded into the threaded bolt holes 254 in the surface 252 of the pocket 234. The bolts 248*a* are shown locking the cover 238*a* into position. Additional bolting scheme embodiments include a continuous through hole through the collar from one pocket to the adjacent pocket to receive a continuous securing member. For example, a bolt and a nut can be secured in the through hole. Alternatively, two bolts connected to a threaded sleeve can be positioned in the through hole. Alternatively, two nuts can be connected to a threaded rod positioned in the through hole. See FIG. 14 for continuous securing members 248*a* locking the covers 238 through the continuous holes 254*a*.

Referring now to FIG. 6, the drill collar assembly 24 of FIG. 5 is rotated approximately 180 degrees such that the "exploded" components of the sensor outsert assembly 225 are viewed generally from above. The inner surface 256 and recess 258 are shown more fully. The bolts 248 protrude through the bolt holes 246. A series of tabs 262 are shown extending from the surface 256 at spaced intervals. Mating grooves 264*a* are spaced at similar intervals on the surface 252*a* of the pocket 234*a*. The mating grooves 264*a* receive the tabs 262*a* (not shown) of the cover 238*a* when the cover is locked into position. The tabs are designed to allow a precision fit to minimize movement between the collar and cover in the axial direction. In some embodiments, the tabs are any shape and size, and not limited to but including round tabs. In some embodiments, the tabs are an integral part of the cover or collar, while in other embodiments the tabs are a separate piece from the cover or collar and removable from the cover or collar to allow assembly or replacement of the tabs.

Figure 7:
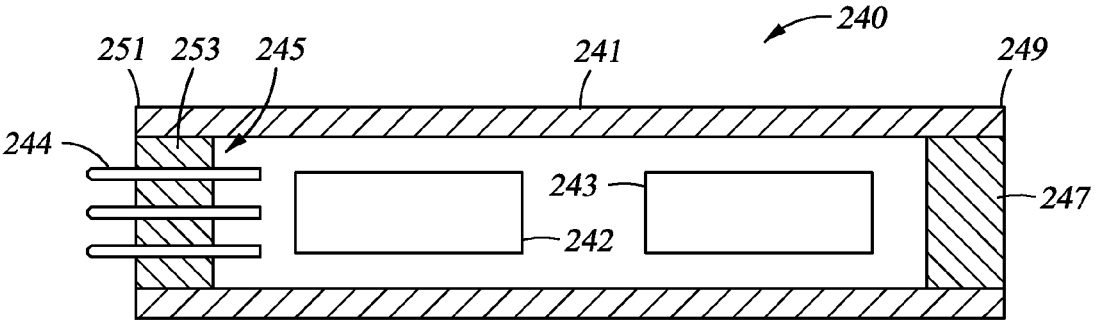
FIG. 7 shows a cross-section view of a sensor outsert according to an embodiment in accordance with principles disclosed herein.

Referring now to FIG. 7, sensor outsert 240 is shown in cross-section. A housing 241 having a first end 249 and second end 251 supports and retains a detector or sensor 242 and an electrical package 243. Electrical package 243 communicates with and supports sensor 242 as is known in the art. The housing 241 may support multiple sensors and multiple electrical packages. At the first end 249 of the housing 241 is a seal 247. At the second end 251 is a connector 245 having a seal body 253 and the electrical connections 244. A connector 245 may be present at one or both ends 249, 251.

The housing 241 is shown as a cylindrical tubular member with concentric outer and inner diameters. However, the housing 241 may be any shape necessary to accommodate the internal components and operating conditions of the drill collar assembly 24. The housing 241 is preferably a pressure housing and the seals 247 and 253 are pressure seals such that the sensor outsert 240 is a sealed pressure vessel. Preferably, the seals 247 and 253 hermetically seal the ends 249, 251 of the pressure housing 241 such that sensor outsert 240 is a hermetically sealed pressure vessel. For example, the connector 245 includes a piston-type O-ring seal 253 that hermetically seals the interior of pressure housing 241 from its exterior, and also seals around the electrical connections 244 that extend from within the pressure housing 41 to beyond the seal 253. The seal 247 may include a hermetic piston-type O-ring seal or a hermetic connector as just described. The connector 245 transmits power and/or data via electrical connections 244. The connections 244 may also include other connections, such as a conduit for a fluid. In various embodiments, the seals 247, 253 include an O-ring elastomer, an O-ring metal, a metal to metal seal, a glass to metal seal, a molded dielectric material to metal seal, or any combination thereof.

In other embodiments of the drill collar assembly 24, the position of the connector 245 is slightly adjusted. In addition to the hermetic connector 245 being located at the end or ends of the sensor outsert 240, other embodiments include a connector located in a portion of the drill collar adjacent the interface between the supporting drill collar and the sensor outsert 240. In yet another embodiment, a hermetic connector 245 is located at an end of the sensor outsert 240 and also in the drill collar at the drill collar interface. In these embodiments, the connection between the hermetically sealed sensor outsert 240 and the drill collar 230 (or other supporting body) at the drill collar interface, regardless of where the connector 45 is located, maintains the hermetic seal of the sensor outsert relative to the exterior of the sensor outsert and exterior of the drill collar.

Figure 8:
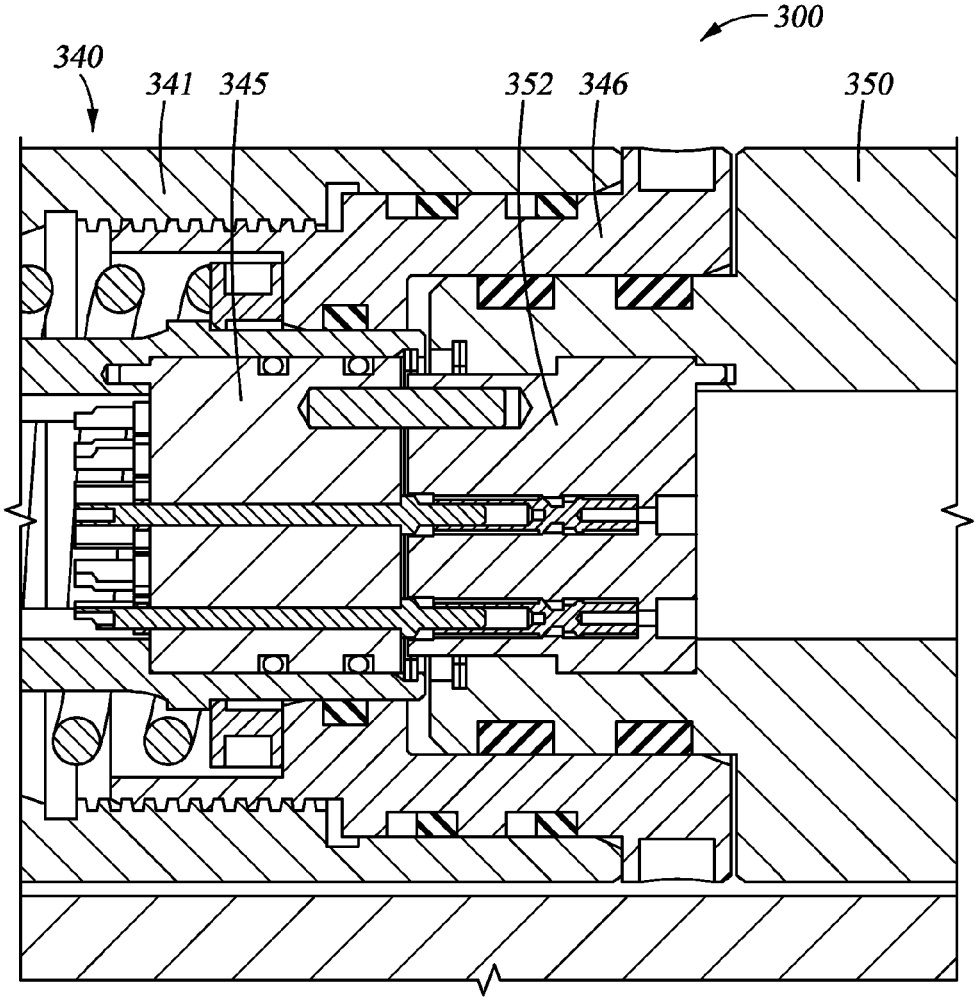
FIG. 8 is a cross-section view of an alternative interface connection between a sensor outsert and a drill collar.
Figure 9:
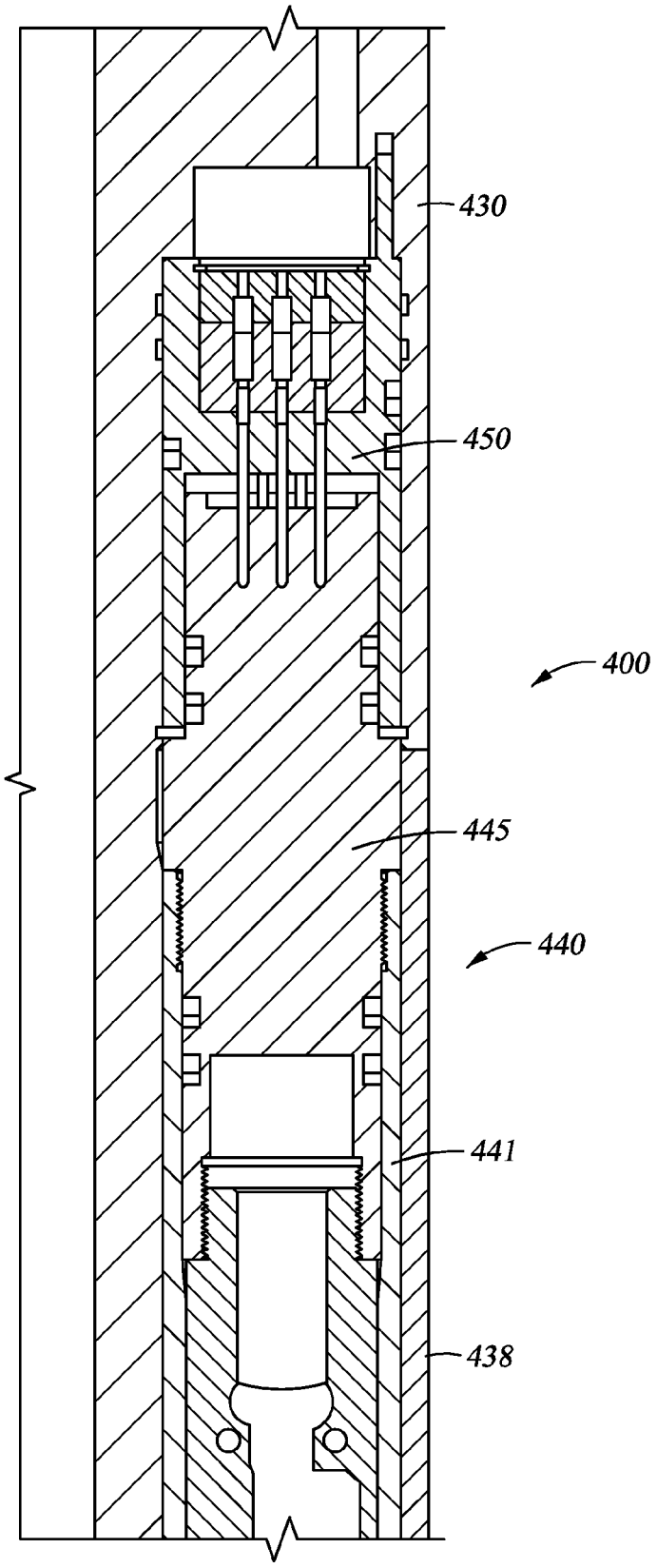
FIGS. 9-12 are various views of another alternative interface connection between a sensor outsert and a drill collar.
Figure 10:
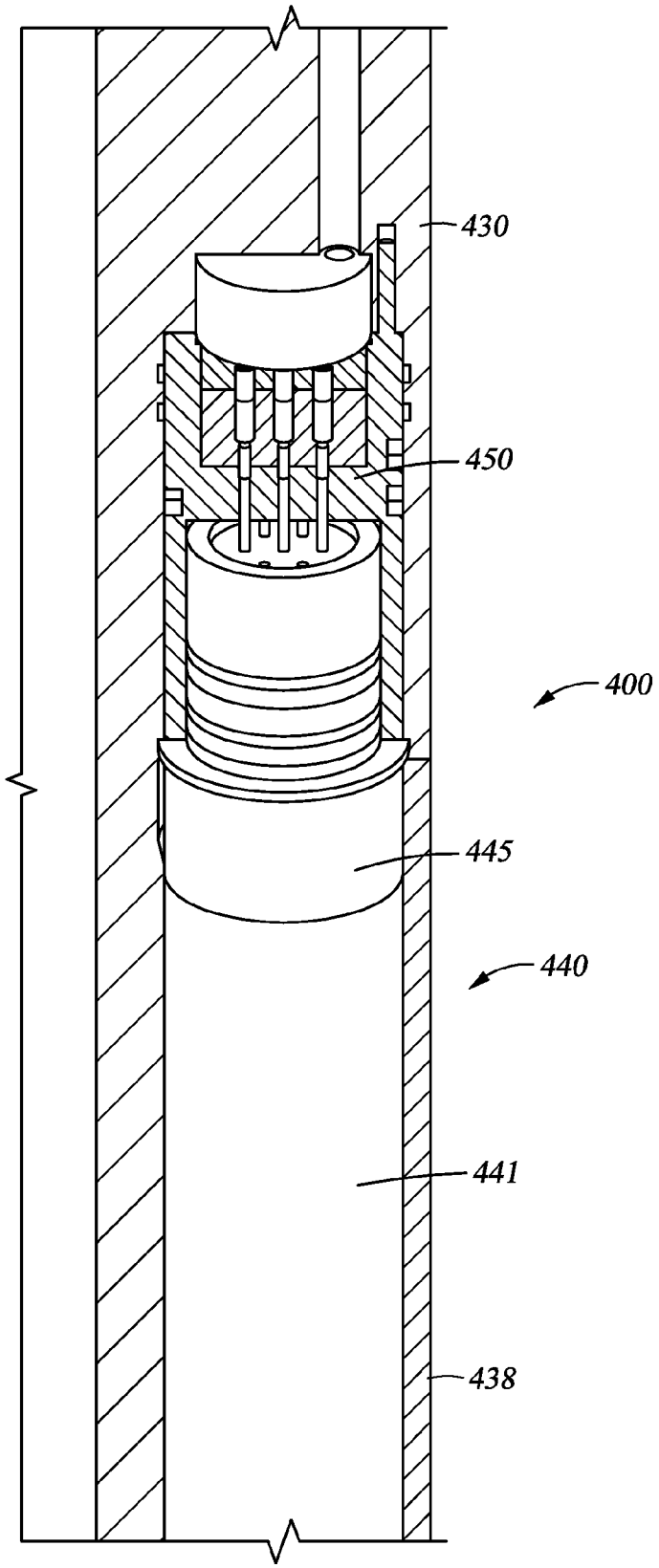
Figure 11:
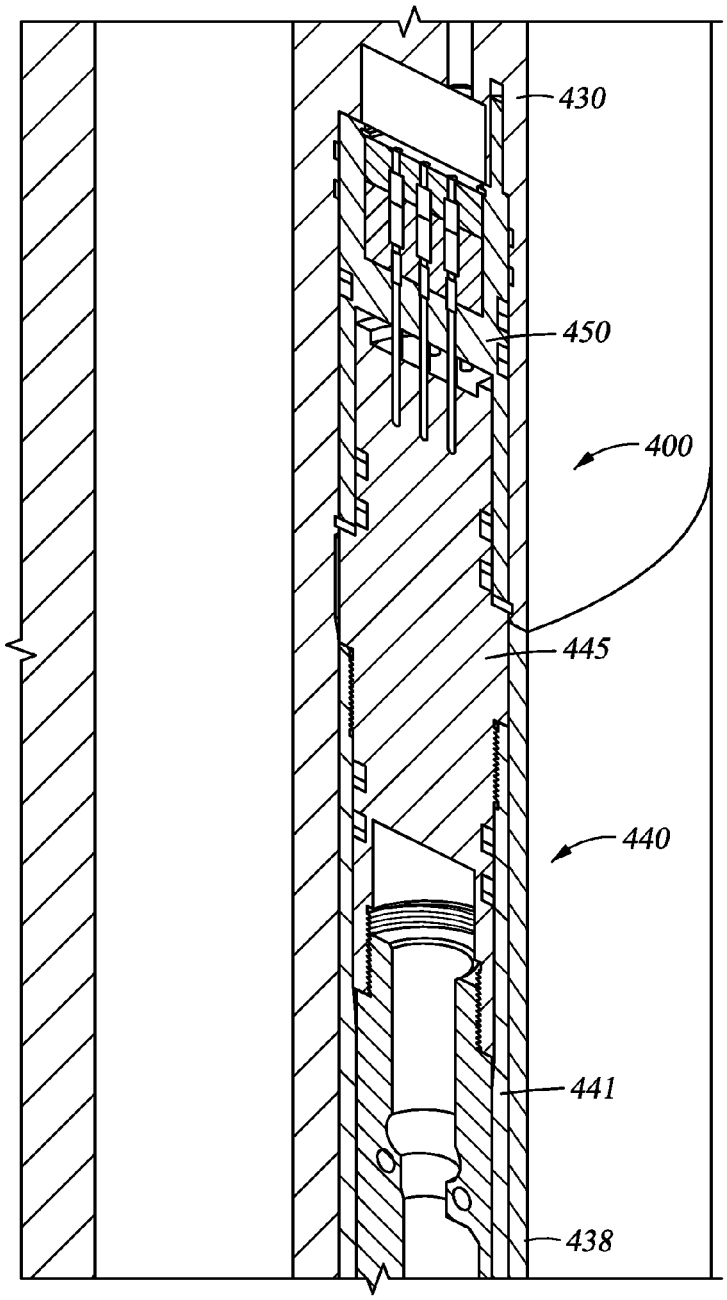
Figure 12:
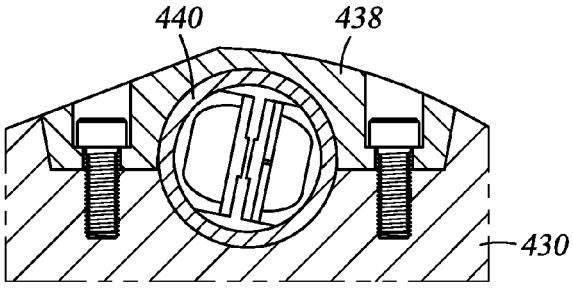

In at least one embodiment, the interface between the sensor outsert and the collar or other containment body is shown as connection 300 in FIG. 8. An outsert 340 is similar to the outsert 240 of FIG. 8, in that the outsert 340 includes a pressure housing 341 and a hermetic connector 345. In some embodiments, the connection 300 includes an adapter block 350 that seals to the collar. An adapter block connector 352 couples between the adapter block 350 and the hermetic connector 345. In some embodiments, the adapter block connector 352 is hermetic, while in other embodiments it is non-hermetic. In some embodiments, the adapter block connector 352 is male, while in other embodiments it is female. An intermediate member 346 assists in coupling and sealing these various components as shown in FIG. 8. The coupled connectors 345, 352 establish various electrical and/or fluid conduits, as shown, between the sensor outsert 340 and the drill collar. The hermetic connector 345 maintains the integrity of the sealed pressure housing 341 even while coupled with the connector 352. As noted, in some embodiments the connector 352 is also hermetically sealed to maintain the pressure integrity of the overall connection 300. The sensor outsert 340 can be de-coupled from the connector 352 and removed from the drill collar pocket, and the hermetic connector 345 continues to maintain the integrity of the sealed pressure housing 341.

In at least one embodiment, the interface between the sensor outsert and the collar or other containment body is shown as connection 400 in FIGS. 9-12. An outsert 440 includes a pressure housing 441 and a hermetic connector 445. A cover 438 encloses the outsert 440 in a pocket of a drill collar 430. The collar 430 includes a mating hermetic connector 450 to receive and couple to the outsert hermetic connector 445 as shown. The coupled connectors 445, 450 establish various electrical and/or fluid conduits, as shown, between the sensor outsert 440 and the drill collar 430. The hermetic connector 445 maintains the integrity of the sealed pressure housing 441 even while coupled with the connector 450. The connector 450 is also hermetically sealed to maintain the pressure integrity of the overall connection 400. The sensor outsert 440 can be de-coupled from the connector 450 and removed from the drill collar pocket, and the hermetic connector 445 continues to maintain the integrity of the sealed pressure housing 441.

The connections 300, 400 are releasable, allowing the sensor outserts to be connected and disconnected as desired. In other embodiments, the connections include a "hard wire" or "hard connect" between the outsert and the collar assembly, wherein additional features add to the securement and retention of the connections while maintaining the removability and changeability of the outsert. Certain retention mechanisms are described more fully below. The connections 300, 400 transmit power and data via electrical signals over electrical connections. Alternatively, the connection interfaces between the outsert and collar assemblies described herein include power and/or data transmission using electromagnetic waves, hydraulic flow, pressure signals, acoustic waves, fiber optic signals, and other means.

The sensor 242 is any type suitable for downhole use, such as those for detecting formation properties, mud properties, direction of a tool in the borehole, direction of the borehole itself, pressure, temperature, dynamic drilling conditions, and other properties and conditions. Any type of electrical component or package which is suitable for downhole use may be housed in the sensor outsert 240.

Figure 13:
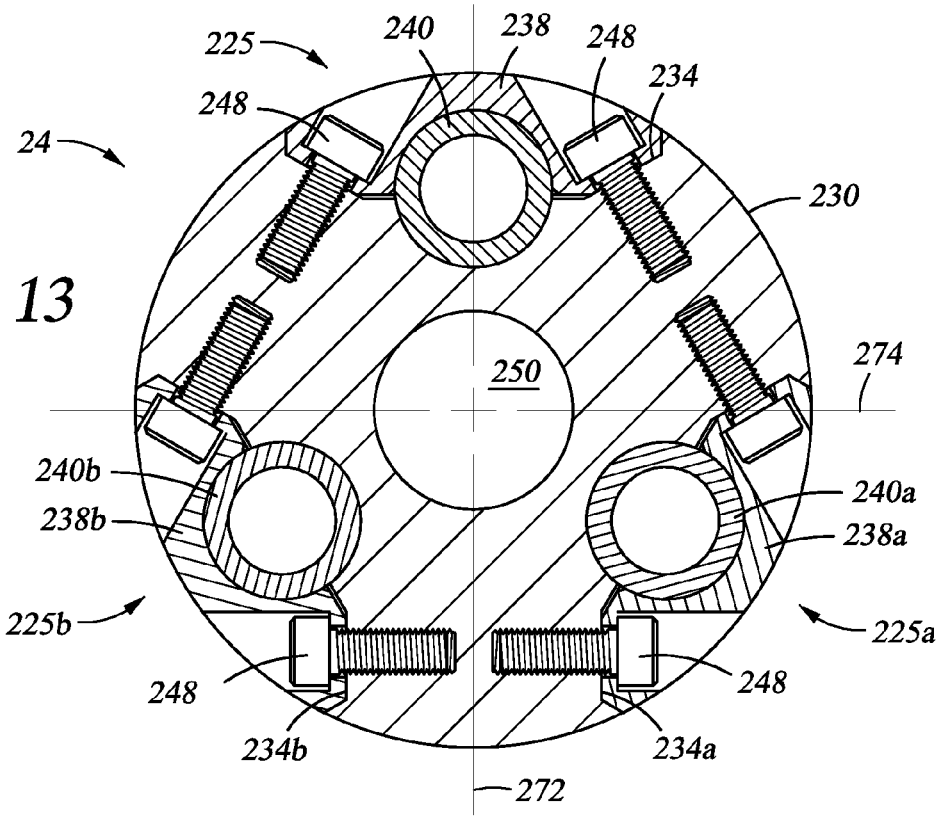
FIG. 13 shows a cross-section view of the drill collar assembly along section A-A of FIG. 5 illustrating secured covers over sensor outserts.

Referring next to FIG. 13, a cross-section of the drill collar assembly 24 along section A-A of FIG. 5 is shown. The outsert assembly 225 is shown fully assembled in the pocket 234. The outsert assemblies 225*a*, 225*b* are also shown assembled in the pockets 234*a*, 234*b*, respectively. The outsert assemblies are shown disposed about the drill collar 230 outer surface approximately 120 degrees apart, and generally reside in the same radial planes of the collar 230. However, as previously described, the outsert assemblies may be positioned differently in various other embodiments of the assembly 24.

Referring to the outsert assembly 225, the bolts 248 lock the cover 238 over the outsert 240. Although the cover 238 is not necessary for outsert 240 retention, as other outsert retention features are disclosed herein, the cover 238 may be used to provide protection for the outsert 240 from wear and impact loads. The cover 238 generally does not provide sealing, and does not require hermetic sealing at least because the sensor outsert 240 is a sealed pressure vessel with a hermetic connector as previously described.

Figure 14:
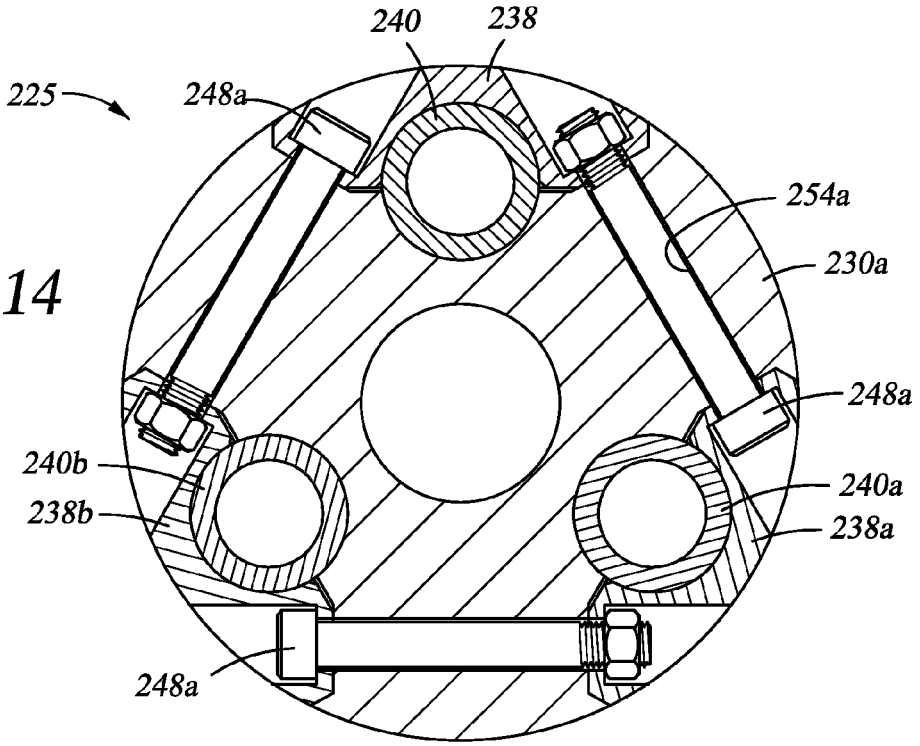
FIG. 14 shows alternatively secured covers over sensor outserts.

In some embodiments of the outsert assembly 225, the cover 238 functions to secure the outsert in the position shown in FIG. 13, as well to protect the outsert 240. Thus, the cover 238 is the primary retention feature for the outsert 240. As the cover 238 is bolted and secured to the collar 230 as shown in FIGS. 5, 6 and 13, the cover 238 clamps the outsert 240. As shown in FIG. 13, the bolts 248 are positioned at an angle relative to a drill collar axis 272 so as to reduce the shear loads induced on the bolts 248. In some embodiments, the bolts can be in any position and orientation as required for proper function of the assembly. In some embodiments, the bolts are through members 248*a* received in through holes 254*a* between pockets as shown in FIG. 14.

Figure 15:
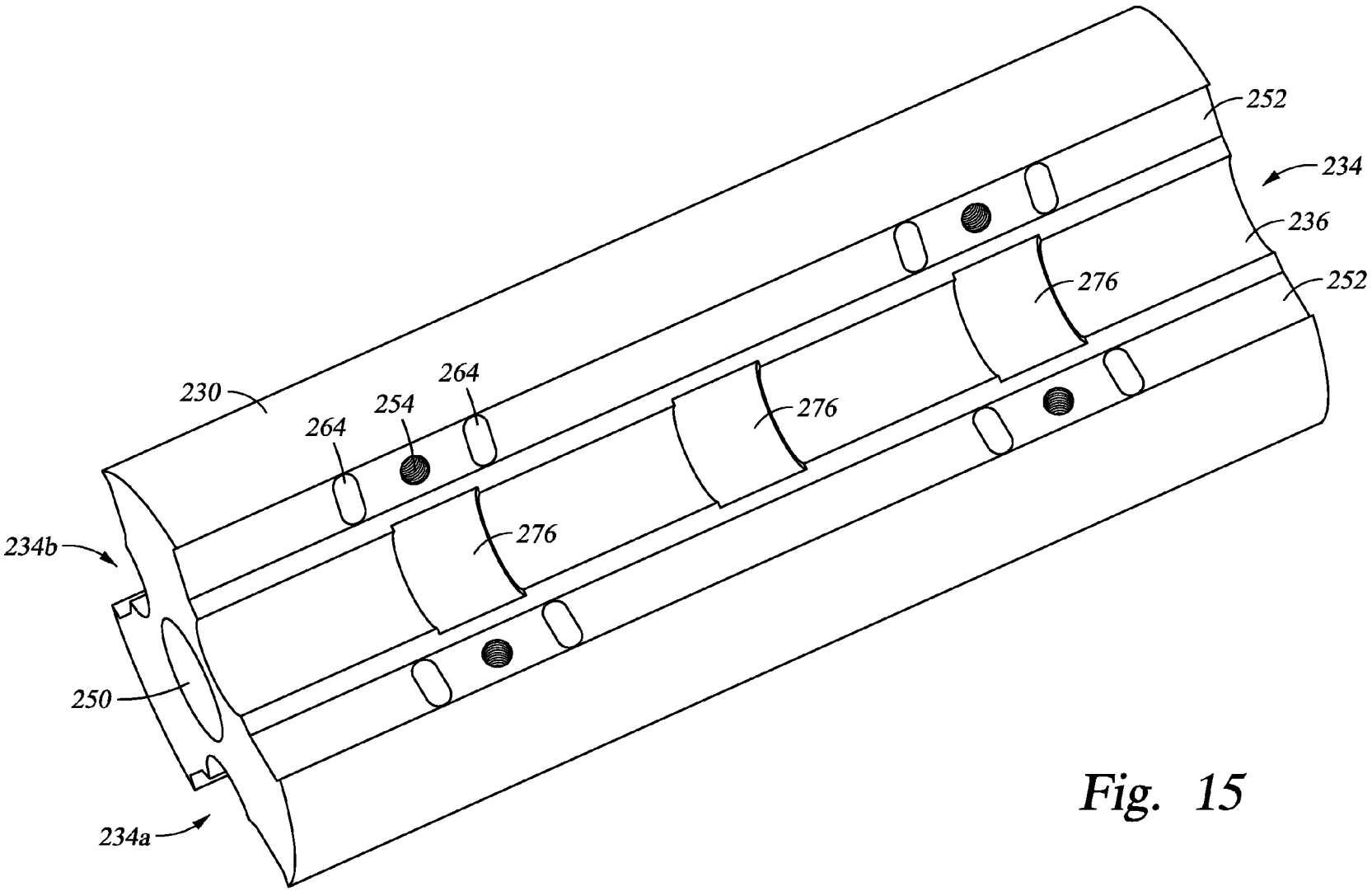
FIG. 15 shows a perspective view of the drill collar of FIGS. 5 and 6.
Figure 16:
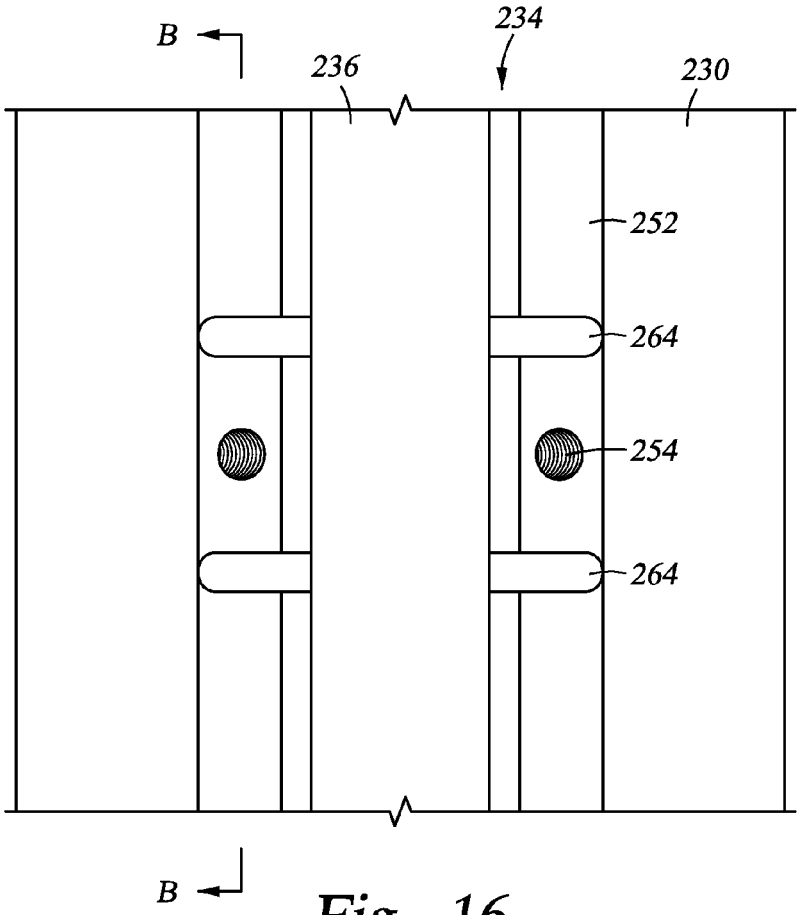
FIG. 16 shows a top view of a portion of the drill collar of FIG. 15.
Figure 17:
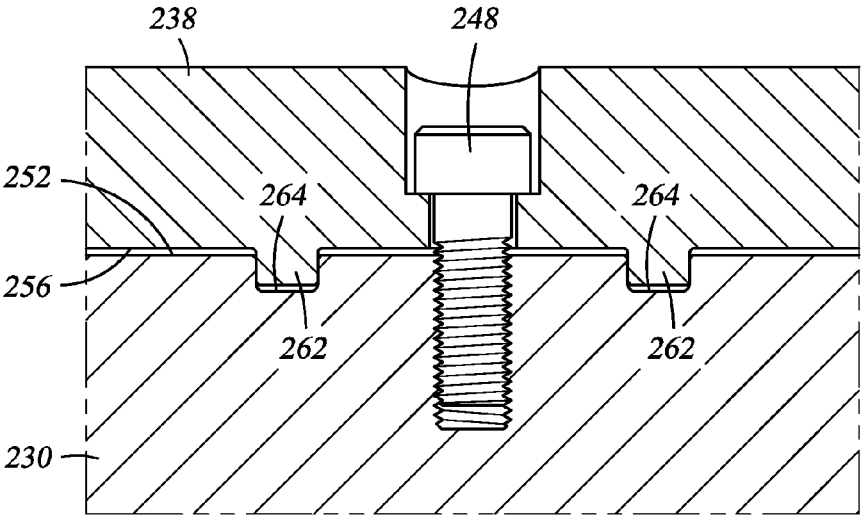
FIG. 17 shows a cross-section view of a portion of the drill collar assembly along section B-B of FIG. 16.

In some embodiments wherein the cover 238 is the primary outsert 240 retention feature, the grooves 264 are added to the cover mounting surface 252 adjacent the bolt holes 254, as shown in FIGS. 5, 6 and 15-17. FIG. 15 shows a perspective view of the drill collar 230 having the pockets 234, 234*a*, 234*b* disposed about the drill collar. The outsert assemblies of FIGS. 5 and 6 are not shown in FIG. 15. The pocket 234 is shown having the cover mounting surface 252 with the grooves 264 adjacent the bolt holes 254. Referring now to FIG. 16, which is a top view of a portion of the drill collar 230 of FIG. 15, the grooves 264 are disposed adjacent the threaded bolt hole 254. Alternatively, the grooves 264 are disposed at various other locations along the cover mounting surface 252. Referring now to FIG. 17, a cross-section view of the drill collar 230 of FIG. 16 along section B-B is shown, with the addition of the cover 238 and the bolt 248 being locked in place as shown in FIGS. 5, 6 and 13. In FIG. 17, the surface 256 of the cover 238 includes tabs 262 (shown also in FIG. 6). When the bolt 248 locks the cover 238 into place, the cover surface 256 mates with the cover mounting surface 252 and the tabs 262 interlock with the grooves 264. The interlocked tabs and grooves reduce the amount of shear loading on the bolts 248 in the axial direction of the drill collar 230. As the drill collar experiences torsional actions, some of the torsional forces are transferred to the cover 238 via the tabs 262 which react against the grooves 264.

Alternative embodiments of the tab and groove combination also allow the cover 238 to lock to the collar 230 and function as a load bearing structural member of the collar. Such alternative embodiments include precision dowel pins with mating holes, removable keys in mating grooves, notched surfaces on the collar and the cover, and specifically defined surface finishes for the mating surfaces of the cover and the collar to provide a friction lock with a preloaded cover. The present disclosure also contemplates other means for adding torsional and bending stiffness to the collar 230 via the cover 238.

In other embodiments of the outsert assembly 225 and the drill collar 230, the cover 238 secures and retains an intermediate retention mechanism which then secures the outsert 240. Machining components such as the sensor outsert 240 and the outsert groove 236 on the drill collar 230 to a precise fit can be costly. Thus, to accommodate for any space between the outsert 240 and the groove 236 that may allow movement of the outsert 240 when installed, an intermediate retention mechanism may be used.

Referring back to FIG. 15, an embodiment of the pocket 234 of the collar 230 includes an outsert groove 236 having bearing band grooves 276. As shown in FIGS. 5 and 6, the sensor outsert 240 includes bearing bands 278 disposed on the outer surface of the outsert 240. The outsert groove 258 of the cover 238 also includes bearing band grooves 277. When the cover 238 is installed, the bearing bands 278 are compressed between the collar 230 and the outsert 240 as well as between the outsert 240 and the cover 238. Thus, the bearing bands 278 act as an intermediate retention mechanism. The mating bearing band and bearing band grooves may include various locations, such as adjacent the cover bolt 248 location, a location in between the bolt locations, or various combinations of these locations. Other embodiments of the intermediate retention mechanism include a split saddle block and polyetheretherketone (PEEK) attached to the outsert 240.

In still other embodiments of the outsert assembly 225 and the drill collar 230, the cover 238 does not secure the outsert 240 and functions as a protective cover only. In these embodiments, a primary retention mechanism is used to secure the outsert directly to the collar 230, and the cover 238 is installed and secured directly to the collar 230. Examples of a primary retention mechanism are shown in FIGS. 18-21.

Figure 18:
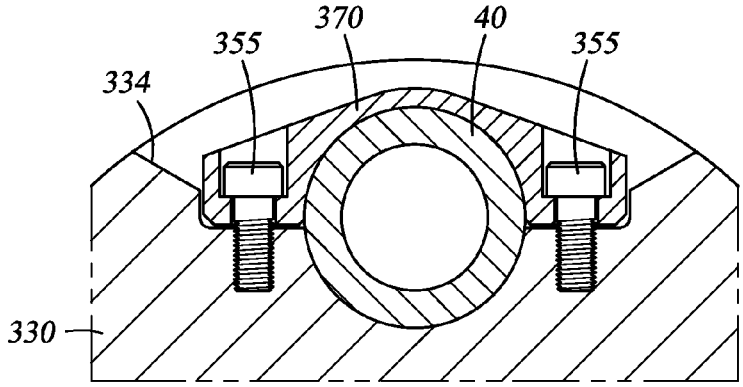
FIG. 18 shows a partial cross-section view of an outsert primary retention mechanism.

Referring to FIG. 18, a partial cross-section view of a drill collar assembly, similar to the view of FIG. 5, is shown including a drill collar 330, the sensor outsert 40 and a primary retention member 370. The sensor outsert 40 is retained in a pocket 334 by a saddle strap 370 bolted to the drill collar 330 by bolts 355. A cover, similar to the cover 38, may be attached over the saddle strap 370.

Figure 19:
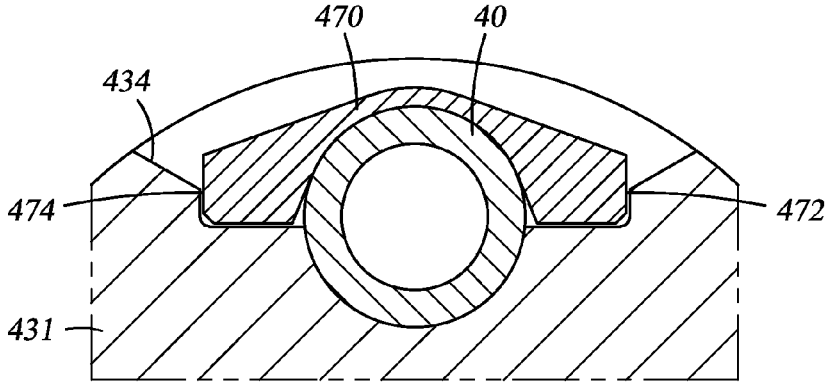
FIG. 19 shows a partial cross-section view of an alternative embodiment of the primary retention mechanism.

Referring now to FIG. 19, an alternative embodiment including a primary retention member 470 is shown in a view similar to FIG. 18. The outsert 40 is installed in a pocket 434 of a drill collar 431. The outsert 40 is covered in the pocket 434 by a saddle strap 470, which is then retained via barb snap features 472, 474. A cover, similar to the cover 38, may be attached over the saddle strap 470.

Figure 20:
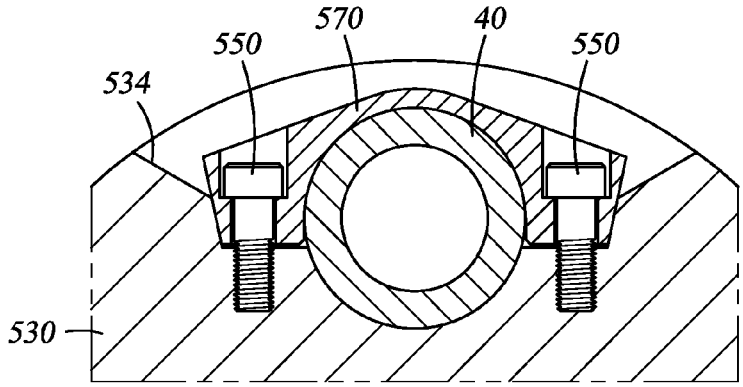
FIG. 20 shows a partial cross-section view of another alternative embodiment of the primary retention mechanism.

Referring now to FIG. 20, an alternative embodiment including a primary retention member 570 is shown in a view similar to FIGS. 18 and 19. The outsert 40 is installed in a pocket 534 of a drill collar 530. The outsert 40 is retained in the pocket 534 by a direct wedge lock one piece saddle strap 570 bolted to the drill collar 530 by bolts 550. A cover, similar to the cover 38, may be attached over the saddle strap 570.

Figure 21:
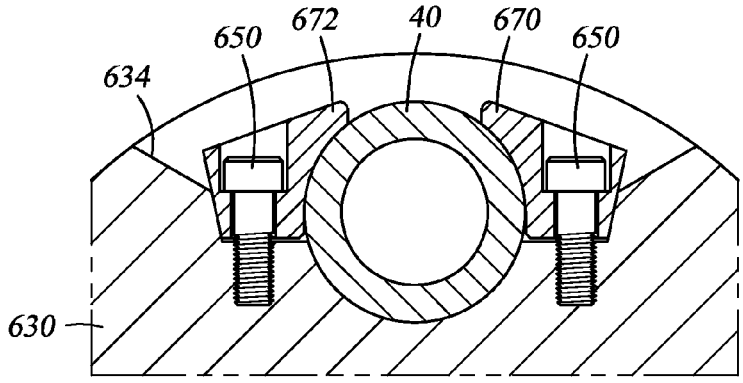
FIG. 21 shows a partial cross-section view of yet another alternative embodiment of the primary retention mechanism.

Referring now to FIG. 21, an alternative embodiment including primary retention members 670, 672 is shown in a view similar to FIGS. 18-20. The outsert 40 is installed in a pocket 634 of a drill collar 630. The outsert 40 is retained in the pocket 634 by a direct wedge lock multi-piece apparatus including wedges 670, 672 bolted to the drill collar 630 by bolts 650. A cover, similar to the cover 38, may be attached over the wedges 670, 672.

Figure 22:
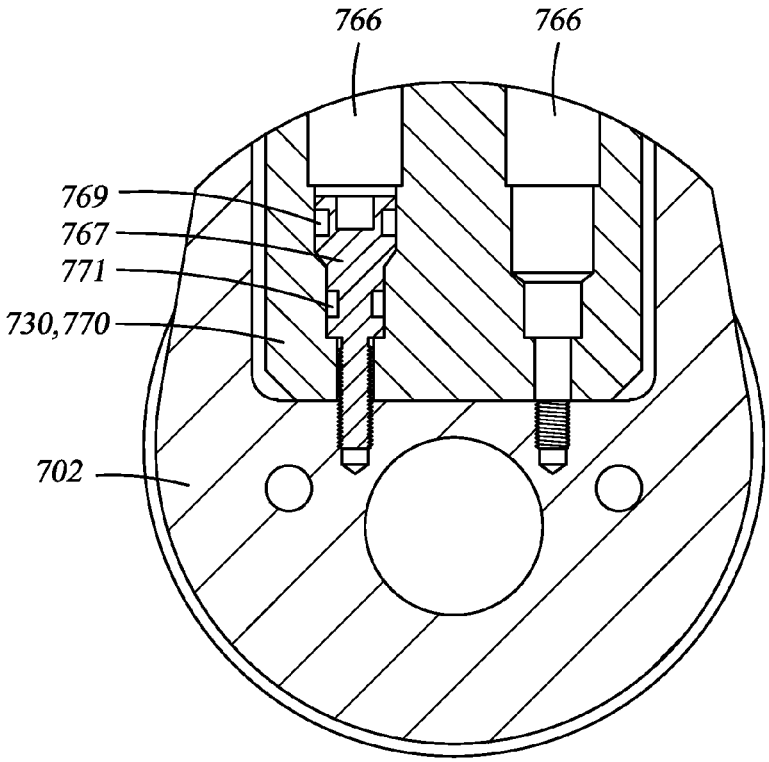
FIG. 22 is a radial cross-section view of hydrostatic locking screws in a drill collar.

Referring to FIG. 22, the outserts described herein may be secured by hydrostatic locking bolts or screws. A member 730, such as an outsert, spacer block, or other component described herein, includes bores 766 for receiving retention screws 767 that pass through the bores 766 and into the drill collar 702. The retention screws 767 include different sized o-ring grooves 769, 771 that create a pressure differential when the drill collar is subjected to downhole hydrostatic pressure, resulting in net force into the drill collar 702.

Figure 23:
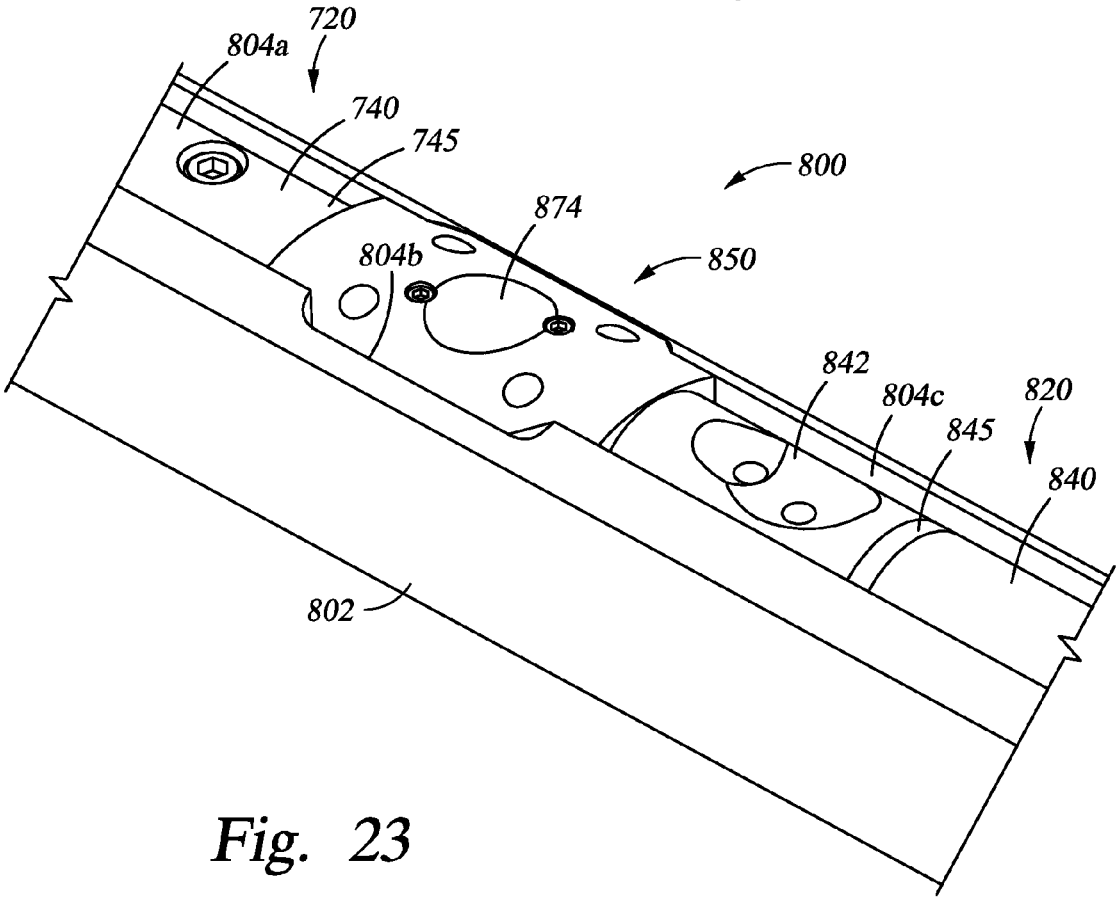
FIG. 23 is a perspective view of an alternative embodiment of a drill collar assembly including multiple sensor outserts coupled by an interconnect junction.
Figure 24:
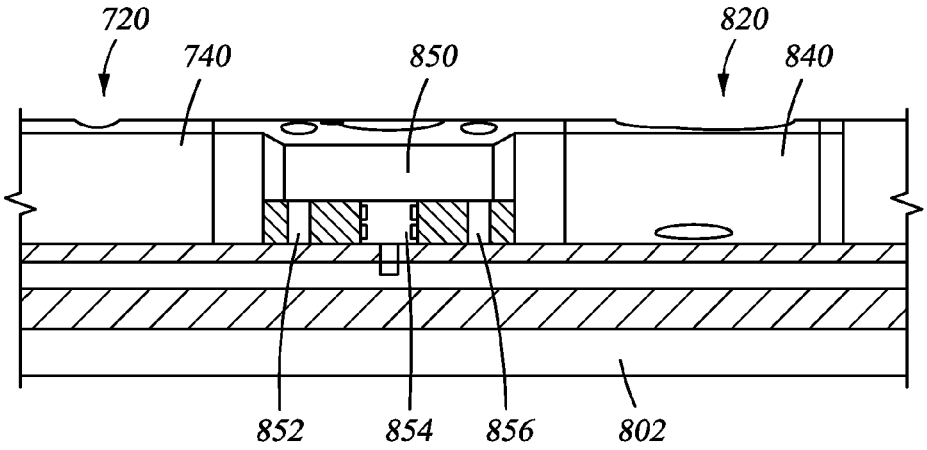
FIGS. 24-28 are various views of the interconnection junction of FIG. 23.
Figure 25:
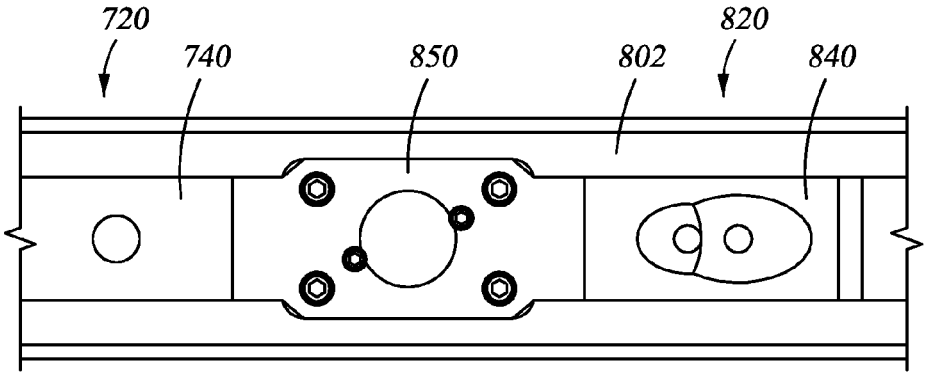

Referring to FIG. 23, another embodiment of a tool is shown as tool 800. Tool 800 includes a drill collar or tool body 802 having pocket portions 804*a*, 804*b*, 804*c*. The pocket 804*a* receives and retains a sensor package 720 having an outsert 740 consistent with the various embodiments described herein. Axially displaced from the sensor package 720 in the pocket 804*c* is a second sensor package 820 including an outsert 840. A connection end 845 of the outsert 840 may include a transceiver assembly 842.

Figure 26:
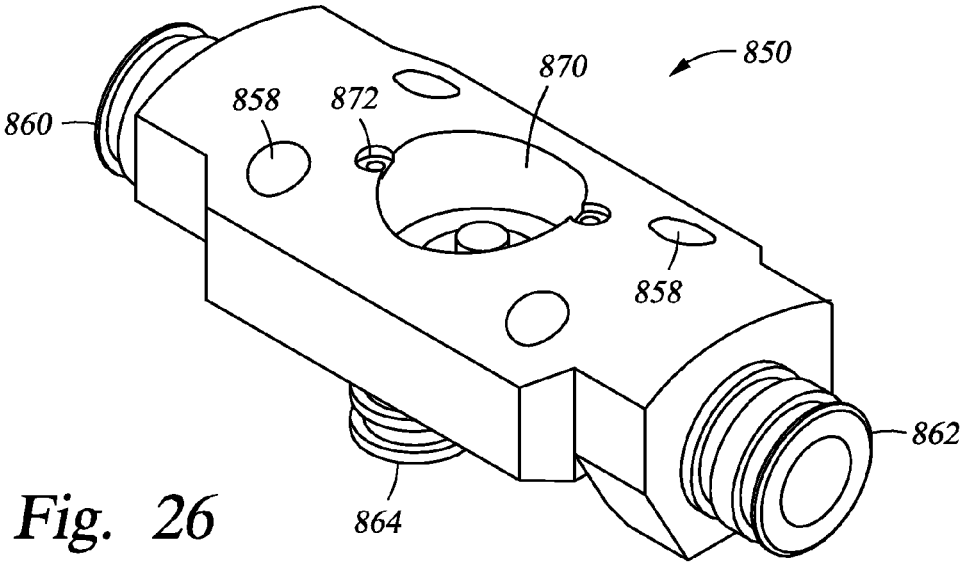
Figure 27:
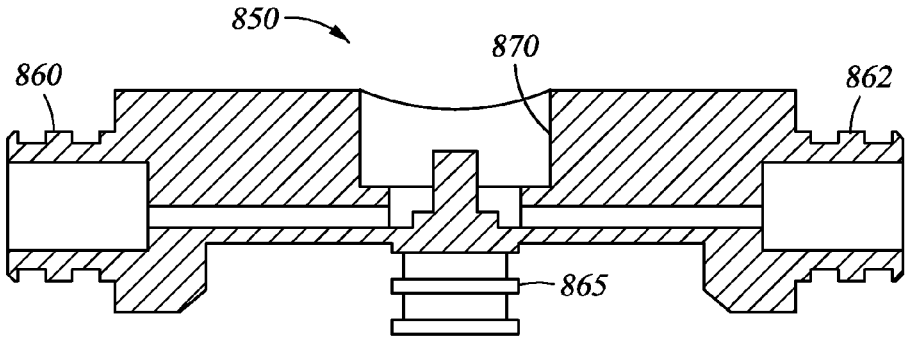
Figure 28:
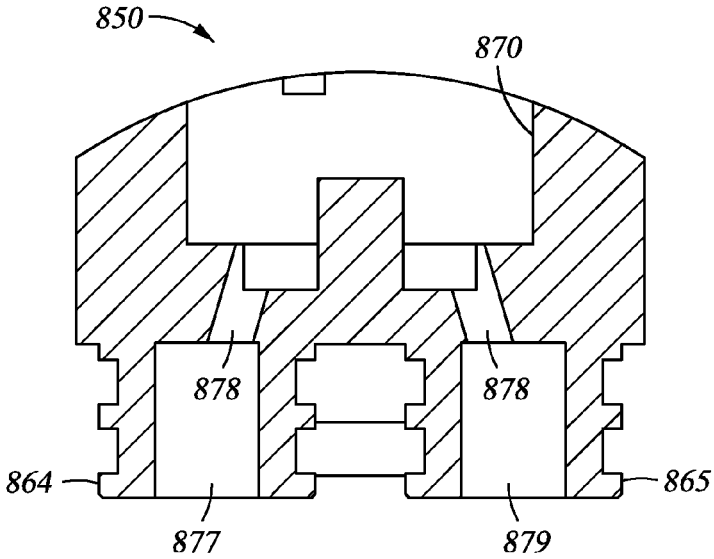

Still referring to FIG. 23, disposed between the outsert sensor packages 720, 820 is a bulkhead or interconnect junction 850. The junction 850 serves as a manifold, providing electrical connections between and among the outserts 740, 840 and the drill collar 802. The junction 850 further serves as a retention mechanism in a radial manner for the outsert connection ends 745, 845 and in an axial manner for the outserts 740, 840. Referring to FIGS. 24-28, the junction 850 connects between the outserts 740, 840 and provides multiple passageways 852, 854, 856 for electrical conduits. As shown in FIG. 26, the junction 850 includes bosses 860, 862 for receiving and coupling to the ends of the outserts 740, 840. The junction 850 also includes bosses 864, 865 for coupling to the drill collar 802. The bosses include passageways for carrying electrical connections and conduits, such as passageways 876, 877, 878, 879. An upper access cavity 870 may be covered by a cover 874 secured by screws threaded into bores 872. The junction 850 may be secured to the tool 800 by screws threaded into bores 858.

Figure 29:
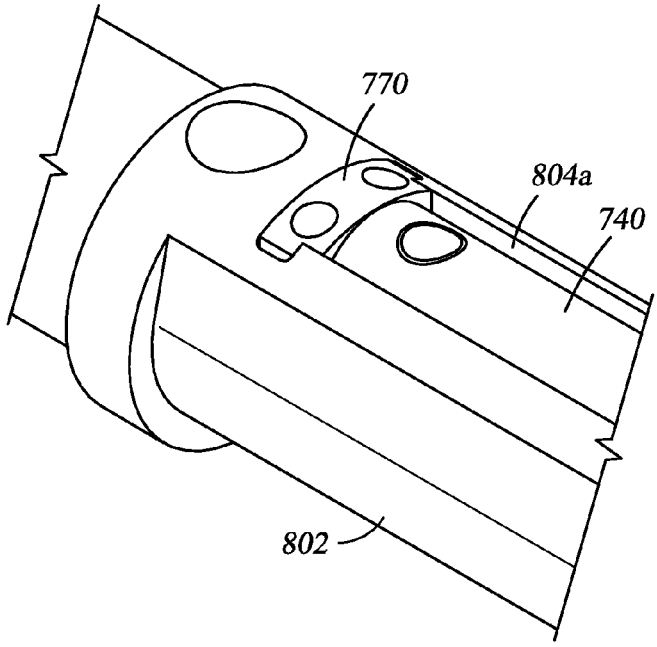
FIG. 29 is a perspective view of an alternative embodiment of a drill collar assembly including a sensor outsert with a spacer block.

Some embodiments include a bolted retention member or spacer block 770 as shown in FIGS. 22 and 29. The spacer block 770 prevents axial movement of the outsert 740. Specifically, the outsert 740 is installed in the collar 802 by positioning the sealing end 745 of the outsert 740 adjacent to the aforementioned bulkhead or interconnection junction 850. Next, the outsert 740 is moved axially so as to engage the seals of the outsert 740 at sealing end 745 with the mating sealing boss 860 of the interconnect junction 850. The spacer block 770 is then installed in the gap between the non-sealing end of the outsert 740 and the end of the collar pocket 804*a* as shown in FIG. 29. This "packed" arrangement prevents the outsert 740 from moving in the axial direction. The aforementioned hydrostatic locking bolts 767 are used to secure the outsert ends as well as the spacer block 770. In some embodiments, use of one or more spacer blocks and hydrostatic locking screws can be applied to one or more outserts.

Figure 30:
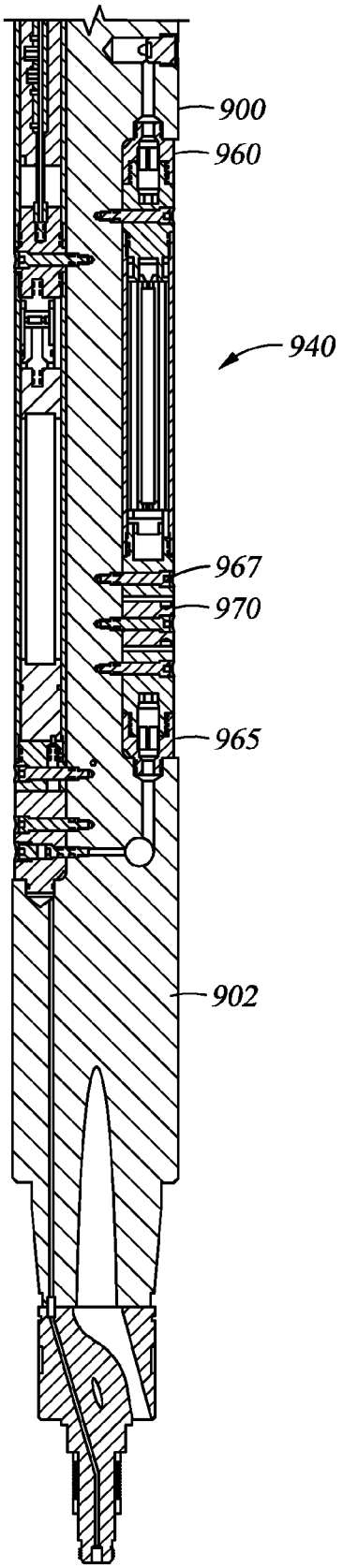
FIGS. 30-34 show various views of an alternative axially expandable sensor outsert assembly.
Figure 31:
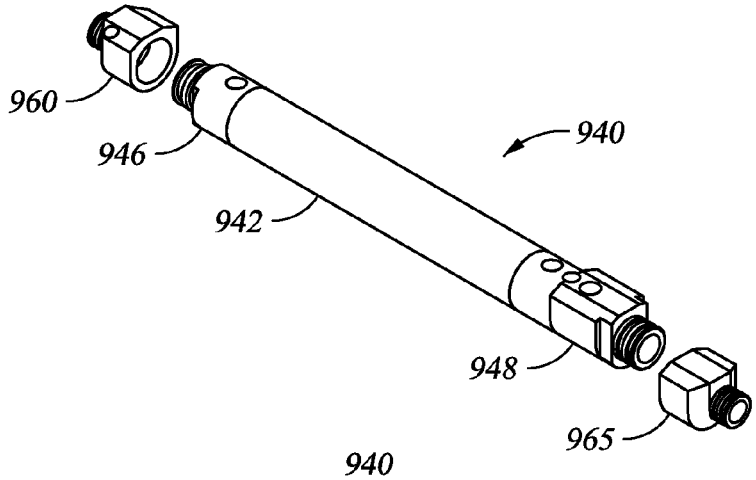
Figure 32:
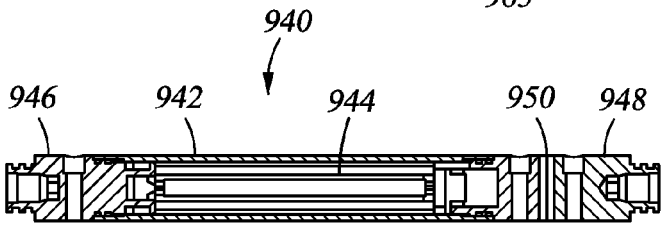

In some embodiments, the sensor outsert is designed to be expandable and have connections on each end. Referring to FIG. 30, a drill collar assembly 900 includes a sensor outsert assembly 940 coupled into a pocket in a drill collar 902 between bulkhead adapters 960, 965 and a spacer block 970. Referring to FIGS. 31 and 32, the sensor outsert assembly 940 includes a pressure housing 942 surrounding internal sensor components 944. Hermetic end connectors 946, 948 are disposed at each end of the outsert assembly as shown, with the end connector 948 including an interface 950 with the respective end of the sensor housing 942. As shown in FIG. 31, bulkhead adapters 960, 965 are separate from the outsert housing 942 and adapted to receive the end connectors 946, 948. The outsert assembly 940 is shown in a closed or contracted position with the interface 950 engaged.

Figure 33:
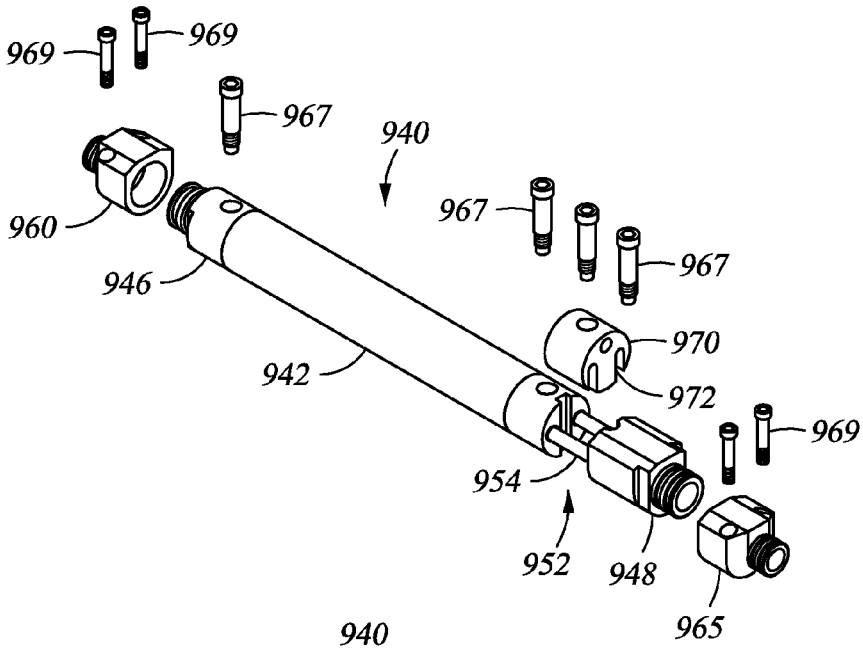
Figure 34:
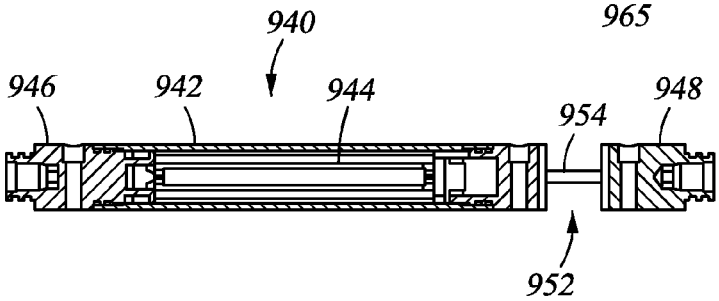

The outsert assembly 940 may be extended to an expanded position. Referring to FIGS. 33 and 34, the interface 950 is released or disengaged and the end connector 948 and outsert housing 942 are moved apart forming a gap 952. Though released from the outsert housing 942, the end connector 948 remains coupled to the outsert housing 942 via the extension rods 954. The extension rod connection is sealed such that the outsert 940 is able to expand and contract while also maintaining hermetic sealing. The expanding and contracting action about the extension rods 954 is sealed using piston type seals. The type of seals for the expanding and contracting function may also include bellows or an expandable bladder. As shown in FIG. 33, a spacer block 970 may be fitted into the gap 952 by placing slots 972 over the extension rods 954. Hydrostatic locking bolts 967 may be used to secure the outsert housing 942, the spacer block 970, and the expanded hermetic end connector 948 against the pocket in the drill collar 902, as shown in FIG. 30. Bolts 969 may be used to secure the bulkhead adapters 960, 965.

To install the outsert assembly 940, the outsert is contracted or closed as shown in FIG. 32. The bulkhead adapters 960, 965 of FIG. 31 are connected into their respective ends of the collar pocket as shown in FIG. 30. The outsert 940 is then positioned in the collar pocket with each end connector 946, 948 facing its respective bulkhead adapter 960, 965. The outsert is extended as shown in FIGS. 33 and 34 such that each hermetic end connector is inserted into its respective bulkhead adapter. The spacer block 970 is then inserted into the gap 952 and over the extension rods 954 of the extended outsert assembly. Finally, the hydrostatic locking bolts 967 are used to secure the spacer block 970 as well as the outsert assembly 940 in the collar pocket as shown in FIG. 30.

The embodiments described herein provide for a downhole sensor or detector to be packaged in a sealed housing. The sealed housing, or outsert, is connectable with a tool body interface. The connection at the tool body interface is also sealable, such that the sealed environment of the pressure housing having the sensor is maintained after the outsert is stabbed into the tool body. The seals, at the ends of the pressure housing and at the outsert/tool body connections, may be hermetic seals. A separate cover may be used to protect and/or retain the outsert in the pocket of the tool body, but the cover need not provide a seal as the outsert is already sealed. The sensor package is therefore not dependent on a cover seal. The removability and sealed nature of the sensor outsert allow the outsert to be a standard component used across a plurality of tool sizes. For example, the same gamma detector outsert may used in a number of different tools of varying sizes. Further, the outsert hardware can be standardized for use with multiple measurements. For example, the detectors and electronics are unique between a gamma outsert and a Drilling Dynamics Sensor (DDS); however, the pressure housing, seals, connectors, connection interface, collar locking mechanism and other hardware may be the same for each type of measurement. Also, the length of the outserts can be easily varied. Thus, the sensor outserts disclosed herein are pressure capsules of a standardized size that mount in a cavity or pocket on the external surface of a downhole collar. The outsert may house the electronics and detectors for an LWD tool such as a neutron logging tool and a density logging tool. Other logging tools may be implemented in outsert form.

As used at times herein, "outsert" may refer to a pressure housing, sonde, or other containment vehicle provided in an outer pocket of the drill collar or tool body. Such a pressure housing is accessible from an exterior of the tool, and places the radially outermost dimension of the pressure housing while in the pocket coincident with or substantially adjacent the outer diameter of the drill collar. In certain embodiments as described herein, the outsert is not internal to the tool and includes pressure sealing independent of a cover, sleeve, or other external pressure case for sealing from the environment exterior of the tool.

The above discussion is meant to be illustrative of the principles and various embodiments of the disclosure. Numerous variations and modifications will become apparent to those skilled in the art once the above disclosure is fully appreciated. It is intended that the following claims be interpreted to embrace all such variations and modifications.

What is claimed is:

1. A downhole sensor apparatus comprising:

a longitudinal body including an exterior pocket;

a sensor housing including at least one sensor to detect a downhole condition, wherein the sensor is hermetically sealed by the sensor housing;

a first electrical connector positioned inside the pocket;

a second electrical connector positioned at a first end of the sensor housing; and an extension rod of the sensor housing coupled between the second electrical connector and the sensor housing;

wherein the second electrical connector is extendable from the sensor housing along the extension rod;

wherein the first and second electrical connectors form a hermetically sealed electrical connection; and wherein the sensor housing is removably coupled to the body in the pocket at the hermetically sealed electrical connection defined between the sensor and the body.

2. The apparatus of claim 1 wherein the sensor is hermetically sealed inside the housing.

3. The apparatus of claim 1 wherein the electrical connection is a hermetically sealed connection.

4. The apparatus of claim 1 further comprising a logging tool coupled to the longitudinal body.

5. The apparatus of claim 1 further comprising a spacer block coupled to the body in the pocket and engaged with the sensor housing to prevent axial movement of the sensor housing.

6. The apparatus of claim 1 further comprising an interconnect junction coupled to the body and the sensor housing in the pocket.

7. The apparatus of claim 1 further comprising a hermetic connector coupled to at least one end of the sensor housing.

8. The apparatus of claim 7 further comprising a body interface to connect to the hermetic connector to maintain the sensor hermetic seal.

9. The apparatus of claim 1 wherein the sensor housing further comprises an interface operable to releasably engage the second electrical connector.

10. The apparatus of claim 9 further comprising a spacer block disposed between the extendable connector and the sensor housing, and a pair of bulkhead adapters coupled to the electrical connection and the extendable connector.

11. The apparatus of claim 1 further comprising a primary retention mechanism disposed over the sensor housing and coupled to the body.

12. The apparatus of claim 11 further comprising a seal-free cover disposed over the primary retention mechanism.

13. The apparatus of claim 1 further comprising a cover disposed over the sensor housing and coupled to the longitudinal body.

14. The apparatus of claim 13 wherein the cover retains the sensor housing in the exterior pocket.

15. The apparatus of claim 13 wherein the cover is seal-free.

16. The apparatus of claim 13 further comprising an intermediate retention mechanism disposed between the sensor and the cover.

17. The apparatus of claim 13 further comprising:

a bearing band groove positioned along the exterior pocket;

a bearing band groove positioned along the cover; and a bearing band positioned around the sensor housing, wherein the bearing band mates with the bearing band grooves of the exterior pocket and cover to thereby secure the sensor housing.

18. The apparatus of claim 1, wherein the end of the sensor housing is hermetically sealed.

19. The apparatus of claim 18 wherein the sensor housing further comprises a second hermetically sealed end opposite the first hermetically sealed end.

20. The apparatus of claim 19, further comprising:

a third electrical connector on the second hermetically sealed end; and a fourth electrical connector positioned inside the pocket, whereby the fourth electrical connector removably couples to the third electrical connector.

21. An apparatus comprising:

a drill collar coupled to a downhole tool, the drill collar having a pocket with an interface;

a sensor outsert containing a sensor, wherein the sensor outsert hermetically seals the sensor from an exterior of the outsert;

a connector to provide a hermetically sealed connection between the sensor outsert and the interface when the sensor outsert is disposed in the pocket; and an extension rod coupled between the sensor and the connector such that the connector is selectively movable along the extension rod to move the sensor outsert between a contracted position and an expanded position.

22. The apparatus of claim 21 wherein the sensor outsert is interchangeable between a plurality of drill collars having various sizes.

23. The apparatus of claim 21 further comprising a cover disposed over the sensor outsert that does not provide a seal.

24. An apparatus comprising:

a tool body having an outer surface with a pocket therein, the pocket accessible from an exterior of the body;

a pressure housing having a sensor hermetically sealed by the pressure housing, the pressure housing to be disposed in the pocket;

a connector to removably and hermetically sealingly couple the pressure housing to the tool body;

an extension rod coupled between the pressure housing and the connector such that the connector is selectively movable along the extension rod while maintaining the hermetically sealed sensor; and a seal-free cover to be disposed over the pressure housing.

25. The apparatus of claim 24 wherein the pressure housing is removable and disposable within another tool body while maintaining the hermetically sealed sensor.

26. A downhole sensor apparatus comprising:

a sensor housing including at least one sensor to detect a downhole condition, wherein the sensor is hermetically sealed by the housing;

the sensor housing including an exterior electrical connector coupled to the sensor inside the hermetically-sealed housing;

the sensor housing including an extension rod coupled between the sensor and the electrical connector such that the electrical connector is selectively movable along the extension rod while maintaining the hermetic seal of the sensor housing; and wherein the electrical connector is connectable to a second electrical connector while maintaining the hermetic seal of the sensor housing.

27. The apparatus of claim 26 wherein the electrical connector is a hermetic connector.

28. The apparatus of claim 26 wherein second electrical connector is disposed in a drill collar.

29. The apparatus of claim 26 wherein the second electrical connector is a hermetic connector.

30. The apparatus of claim 26 wherein the electrical connectors are coupled to form a hermetic connection.

* * * * *